US007174819B1

(12) United States Patent
Petitjean et al.

(10) Patent No.: US 7,174,819 B1
(45) Date of Patent: Feb. 13, 2007

(54) APPARATUS AND METHOD FOR CUTTING A WEB, FEEDING IT INTO A PROCESSING AND THREADING IT UP THROUGH THAT LINE

(75) Inventors: Gilles Petitjean, Arlon (BE); Joseph Aloyse Marnach, Lamadelaine (LU); Luc Marie Hubert Andre Nicolai, Heinsch (BE)

(73) Assignee: DuPont Teijin Films U.S. Limited Partnership, Wilmington, DE (US)

( * ) Notice: Subject to any disclaimer, the term of this patent is extended or adjusted under 35 U.S.C. 154(b) by 0 days.

(21) Appl. No.: 09/622,634

(22) PCT Filed: Feb. 5, 1999

(86) PCT No.: PCT/EP99/00758

§ 371 (c)(1),
(2), (4) Date: Feb. 6, 2001

(87) PCT Pub. No.: WO99/42394

PCT Pub. Date: Aug. 26, 1999

(30) Foreign Application Priority Data

Feb. 20, 1998 (EP) ..... 98400426

(51) Int. Cl.
*B26D 1/00* (2006.01)
*B26D 3/00* (2006.01)

(52) U.S. Cl. ..... 83/13; 83/39; 83/107; 83/428; 242/525.3

(58) Field of Classification Search ..... 83/100, 83/102, 428, 440, 401, 404, 98, 105, 106, 83/107, 923, 13, 39; 242/525.3
See application file for complete search history.

(56) References Cited

U.S. PATENT DOCUMENTS

| | | | | | |
|---|---|---|---|---|---|
| 2,500,772 | A | * | 3/1950 | Reed | 83/105 |
| 3,376,527 | A | | 4/1968 | Risk | |
| 3,465,625 | A | * | 9/1969 | Daly | 83/100 |
| 3,743,197 | A | | 7/1973 | Hawkins | |
| 3,756,527 | A | | 9/1973 | Collins et al. | |
| 3,762,250 | A | * | 10/1973 | Huskey | 83/27 |
| 3,795,164 | A | * | 3/1974 | Schneider | 83/349 |
| 3,937,112 | A | * | 2/1976 | Geeson | 83/57 |
| 4,147,081 | A | * | 4/1979 | Pellaton | 83/407 |
| 4,549,452 | A | * | 10/1985 | Jobst | 83/100 |
| 4,611,518 | A | * | 9/1986 | Hildebrandt | 83/105 |
| 4,771,991 | A | * | 9/1988 | Sankaran | 266/200 |
| 4,817,880 | A | * | 4/1989 | Lenk et al. | 242/366 |

(Continued)

*Primary Examiner*—Boyer D. Ashley
*Assistant Examiner*—Omar Flores Sanchez
(74) *Attorney, Agent, or Firm*—RatnerPrestia

(57) ABSTRACT

The invention relates to an apparatus for cutting of a web (1) conveyed along a conveyance direction (F), and subsequent feeding and threading it up into a processing line, said web (1) comprising a central portion (1*c*) and edges (1*a*, 1*b*), said apparatus comprising central cutting means (2*a*, 2*b*) for cutting the central portion (1*c*) laterally and transversely to the conveyance direction (F) and edge cutting means (3*a*, 3*b*) for cutting the edges (1*a*, 1*b*) transversely to the conveyance direction (F), said apparatus further comprising edge channels (4*a*, 4*b*) for taking up the edges (1*a*, 1*b*) into the processing line, said channels being substantially closed and comprising movable lids. The invention also provides a method for threading up a web in a processing line. The invention finally provides edge channels (4*a*, 4*b*).

11 Claims, 19 Drawing Sheets

U.S. PATENT DOCUMENTS 5,899,129 A * 5/1999 Sumida et al. ..... 83/76.9
6,070,510 A * 6/2000 Poloni ..... 83/37
6,206,321 B1 * 3/2001 Pumpe ..... 242/525.3

* cited by examiner

APPARATUS AND METHOD FOR CUTTING A WEB, FEEDING IT INTO A PROCESSING AND THREADING IT UP THROUGH THAT LINE

FIELD OF THE INVENTION

The invention relates to an apparatus and a method for cutting of a web, feeding it into a processing line, such as a winding unit, and threading it up through that line.

BACKGROUND OF THE INVENTION

The feeding of the webs into a processing line, such as a winding system, after a start/restart of the production is a delicate process in particular for thin webs. A known method for such feeding is to cut off manually an edge or a leader of the web, to take it manually through the processing line, launching a defined start program, and when the edge or the leader is secured on a driving element, to cut the web in such a way that the entirety thereof is finally fed into the processing line.

It will be readily apparent that there is a need for an apparatus and a method that would offer a safe and easy cutting and feeding of the web into the processing line, and that would afford automatic thread up. This need is acute for films with thickness ranging from 100 to 0.4 microns and speeds up to 1000 m/min as well as widths ranging from 1 m to 10 m.

Said need exists for various types of material: polymeric, paper, metallic, etc. "Web" shall thus cover any of this material.

The method of the leader (either manually or automatically) is already known and exemplified in, e.g., U.S. Pat. Nos. 3,756,527 and 3,743,197. These patents teach the use of a single central leader strip that is inserted into the processing line; once said leader strip is secured the strip is broadened up to the full width of the web. The leader strip is transported pneumatically using a slotted tube. This, however, presents drawbacks. Because of the slots, it is not possible to build up a significant pressure gradient along the tube or channel; air speeds and consequently aerodynamic forces are limited. Pulling the leader strip out of the slots is a delicate operation, often ending in breaks with thin films. The tubes hinder the production because centrally located, along the whole line.

An alternate method using the edges present on both sides of the film or web is disclosed in U.S. Pat. No. 4,611,518. According to this document, the method makes use of said edges being first cut from the central part of the web, then fed into the processing line. The mechanism used for achieving this comprises pressure rolls, constituting a nip, which secures the edges, where the edges are then transported by a double belt (called rope scissors) through the machine. This, however, presents drawbacks. The edges can wrap around the pressure rolls, leading to downtime. The system is very complicated. Edge transport with pressure rolls and with a double belt is not convenient in the case of stretched polymeric films because the edge (aka bead) has then a non uniform thickness and may be corrugated and curled (as a result, the edge can get out sidewards).

SUMMARY OF THE INVENTION

The object of the present invention is to provide an apparatus and a method for cutting and feeding a web in an appropriate manner for reliable automatic feeding and threading up in a processing line, such as in a winding system, thereby reducing the rate of failure and hence the production costs.

The invention thus provides an apparatus for cutting of a web (1) conveyed along a conveyance direction (F), and subsequent feeding and threading it up into a processing line, said web (1) comprising a central portion (1*c*) and edges (1*a*, 1*b*), said apparatus comprising central cutting means (2*a*, 2*b*) for cutting the central portion (1*c*) laterally and transversely to the conveyance direction (F) and edge cutting means (3*a*, 3*b*) for cutting the edges (1*a*, 1*b*) transversely to the conveyance direction (F), said apparatus further comprising at least one edge channel (4*a*, 4*b*) for taking up the edge(s) (1*a*, 1*b*) into the processing line and threading it(them) through that processing line, said channel(s) showing a section substantially closed and said channel(s) comprising movable lids (6*a*, 7*a*, 6*b*, 7*b*).

According to one embodiment, the edge channel(s) (4*a*, 4*b*) comprise(s) rotatably mounted inner and/or bottom plate (6*a*, 7*a*, 6*b*, 7*b*) for taking up and releasing the edges (1*a*, 1*b*).

According to another embodiment, the edge channel(s) (4*a*, 4*b*) is(are) provided with pneumatically driven suction means.

According to yet another embodiment, the edge channel(s) (4*a*, 4*b*) is(are) divided into sub-sections.

According to yet another embodiment, the edge channel(s) (4*a*, 4*b*) and the corresponding edge cutting means (3*a*, 3*b*) are mounted jointly, such as on a carriage (8*a*, 8*b*).

According to yet another embodiment, the apparatus comprises two edge channels (4*a*, 4*b*).

According to yet another embodiment, the edge cutting means (3*a*, 3*b*) comprise knife means for cutting off the edges (1*a*, 1*b*). This knife means may be guillotine knifes or shears knifes.

According to yet another embodiment, the central cutting means (2*a*, 2*b*) are mounted to adopt a non-moving state for lateral cutting off the edges (1*a*, 1*b*) from the central portion (1*c*) and a moving state for transversely cutting the central portion (1*c*) while moving towards each other transversely to the conveyance direction (F).

According to yet another embodiment, the cutting means (3*a*, 3*b*) are arranged downstream with respect to the cutting means (2*a*, 2*b*).

According to yet another embodiment, the cutting means (3*a*, 3*b*) are arranged upstream with respect to the edge channel(s) (4*a*, 4*b*).

According to yet another embodiment, the cutting means (3*a*, 3*b*) are arranged downstream with respect to the edge channel(s) (4*a*, 4*b*).

"Processing line" includes one or several machines such as stretchers, coaters, dryers, surface treating machines, slitters, winders, etc., usually with very complicated film paths. A winding unit will receive the invention with advantage.

The invention also provides a method for cutting a web (1) conveyed along a conveyance direction (F), and subsequent feeding and threading it up into a processing line, said web (1) comprising a central portion (1*c*) and edges (1*a*, 1*b*), the method comprising the steps of:

(i) cutting off at least one edge (1*a*, 1*b*) laterally from the central portion (1*c*);

(ii) cutting said at least one edge (1*a*, 1*b*) along a direction transverse to the conveyance direction (F);

(iii) taking up said at least one edge into the processing line through edge channel(s);

(iv) securing said at least one edge in a pulling unit located at the other extremity of the processing line;

(v) opening the channel(s) to release said at least one edge; and (vi) cutting the central portion (1*c*).

According to one embodiment, the taking up step (iii) comprises sucking the edges into tube channels (4*a*, 4*b*).

According to another embodiment, the method further comprises the step of forming a loop of edges at the vicinity of the edge channel during step (ii).

According to yet another embodiment, both edges are processed; said both edges can be processed simultaneously or they can be processed independently or they can be processed sequentially.

According to yet another embodiment, the cutting step (i) comprises a step of keeping the central cutting means (2*a*, 2*b*) at a non-moving state for lateral cutting off the edges (1*a*, 1*b*) from the central portion (1*c*).

According to yet another embodiment, the cutting step (ii) comprises a step of instantaneous transversely cutting of the edges (1*a*, 1*b*).

According to yet another embodiment, the cutting step (vi) comprises moving the central cutting means (2*a*, 2*b*) towards each other transversely to the conveyance direction (F).

According to yet another embodiment, the method of the invention uses the apparatus of the invention.

The invention finally provides an edge channel (4*a*, 4*b*) showing a section substantially closed and comprising movable lids (6*a*, 7*a*, 6*b*, 7*b*).

According to one embodiment, the edge channel (4*a*, 4*b*) comprises rotatably mounted inner and/or bottom plate (6*a*, 7*a*, 6*b*, 7*b*).

According to another embodiment, the edge channel (4*a*, 4*b*) comprises air jets arranged along it.

The advantage of the apparatus and the method according to the present invention lies in the separated handling of the edges and the central portion of the web for the cutting procedure and feeding procedure, allowing appropriate (automatic) feeding of the web into the processing line, handling of the edges being carried out thanks to specific channels.

The invention allows the drawbacks of the prior art to be overcome, is not limited in terms of thickness or speed and show high reliability hence low downtime. The invention makes use of the fact that edges, in case of polymeric films, are much stronger then the central part between them and thus break very seldom. If the web breaks during processing, the edges or only one of them will then automatically re-entrain the web.

The edges are known by-products of the manufacturing procedure of the web and distinguish from the central portion by their higher thickness (allowing handling of the web). The invention proposes to cut these two different components of the web in distinct steps by appropriate means to allow for a different treatment of the components in the later feeding procedure.

Preferably the different cutting treatment of edges and central portion leads to a shape of the transverse cut of the web in such a way that the edges protrude in the conveyance direction. The edges, since they can be better handed, can be fed first into a pulling device or system located at the other extremity of the processing line to entrain afterwards the central portion.

Further, it is possible to use cutting means different in shape and operating procedure for the thin central portion and the thick edges. For instance, guillotine knifes and shears knifes are known as reliable tools for cutting thick but small workpieces and thus are adapted for cutting the edges. For the central portion extending in general over a considerable width, other cutting means transversely movable are more appropriate, such as a Gillette knife or a doctor blade or sharpened needles.

BRIEF DESCRIPTION OF THE DRAWINGS

In the following, the edge channels will be represented with dotted lines for hidden parts at the first occurrence only in each embodiment.

FIGS. 13*a*, 13*b* to 16*a*, 16*b* correspond to FIGS. 9*a*, 9*b* to 12*a*, 12*b*, respectively, for the other edge;

DETAILED DESCRIPTION OF THE INVENTION

The description is given with respect to a web transfer an winding system following an oven or a stretcher but can be applied to any web processing line. Also, the web is here polymeric, (e.g. polyester such as PET), with thickened edges (aka beads), by comparizon with the remaining web. The blades are arranged in such a way that the central portion, once cut, shows a uniform thickness.

First Embodiment

Figure 1A:
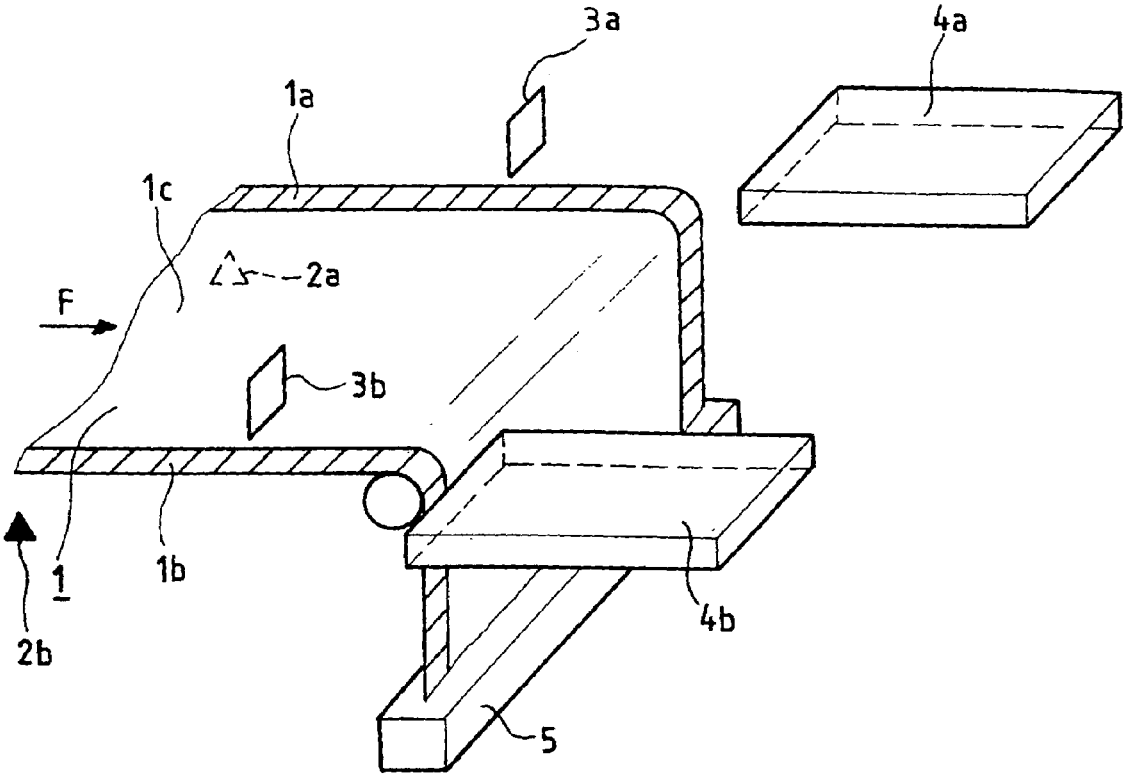
FIGS. 1*a* and 1*b* show a perspective view and a top view, respectively, of an apparatus according to one embodiment of the invention, the web not being cut at all.
Figure 1B:
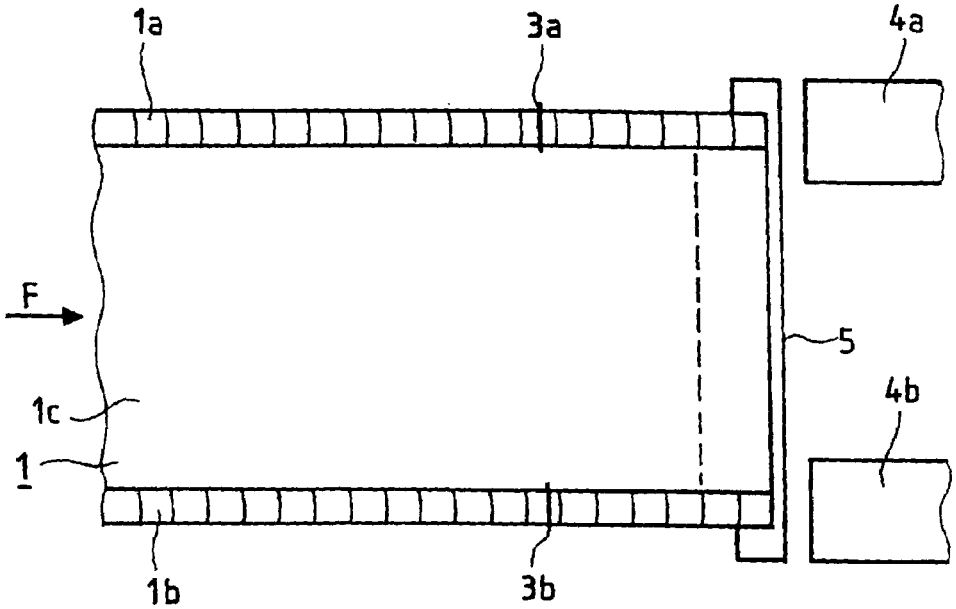

In the apparatus according to the invention as shown in FIGS. 1*a* and 1*b* a web 1 is conveyed in a conveyance direction indicated by arrow F at the exit of an oven or stretcher (not shown). The web is composed of two edges 1*a* and 1*b* defining therebetween a central portion 1*c* of the web 1. On its way along conveyance direction F the web 1 passes a central cutting means comprising two sharpened blades 2*a*, 2*b*. In the initial condition shown in FIGS. 1*a* and 1*b* the blades are in a lower position not cutting the web. Downstream in the conveyance direction F edge cutting means in the form of two guillotine knifes 3*a*, 3*b* are mounted over each of the edges. In the present initial condition the guillotine knifes are in a stand-by state not cutting the edges 1*a*, 1*b*. Further downstream, edge channels 4*a*, 4*b* are placed in close vicinity of the transport roll towards the chute 5 to take up the edges 1*a*, 1*b* after cutting by the edge cutting means 3*a*, 3*b*. The edge channels 4*a*, 4*b* are not activated in the initial condition shown in FIGS. 1*a* and 1*b* and the entire web 1 is falling into the container or chute 5.

Figure 2A:
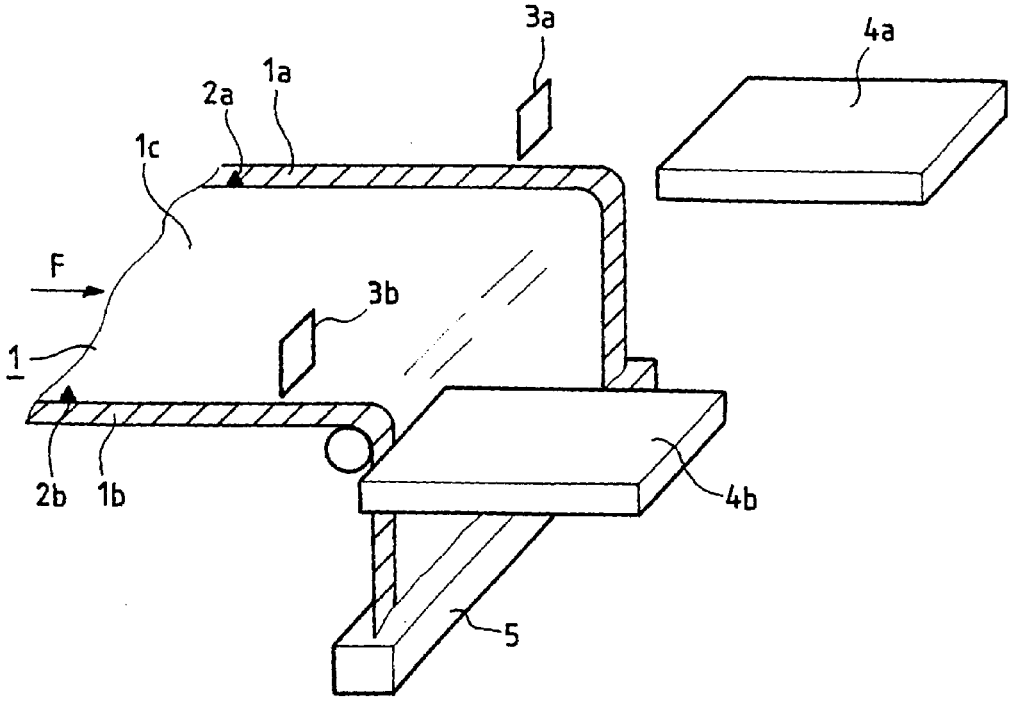
FIGS. 2*a* and 2*b* show a perspective view and a top view, respectively, of an apparatus according to one embodiment of the invention, the edges being cut off laterally from the central portion of the web.
Figure 2B:
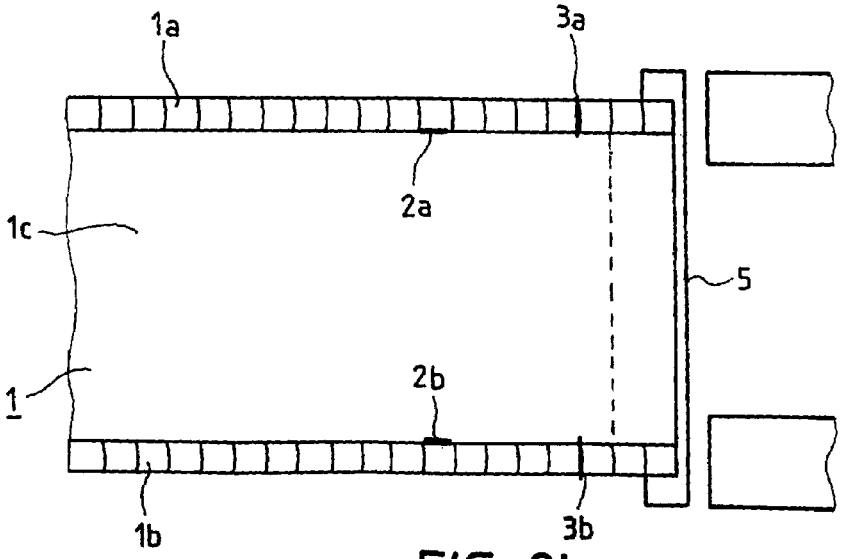

In operation the apparatus according to the first embodiment functions as follows:

At a given moment t0, as can be seen from FIGS. 2*a* and 2*b*, the blades 2*a*, 2*b* are lifted to a position where they protrude through the web between the edges and the central portion thus cutting the web into said central portion 1*c* and the two edges 1*a* and 1*b*. In this position the blades are not moved in the plane of the web, therefore being in a non-moving state. Downstream of the blades the central portion and the separated edges continue to fall in the container 5.

Figure 3A:
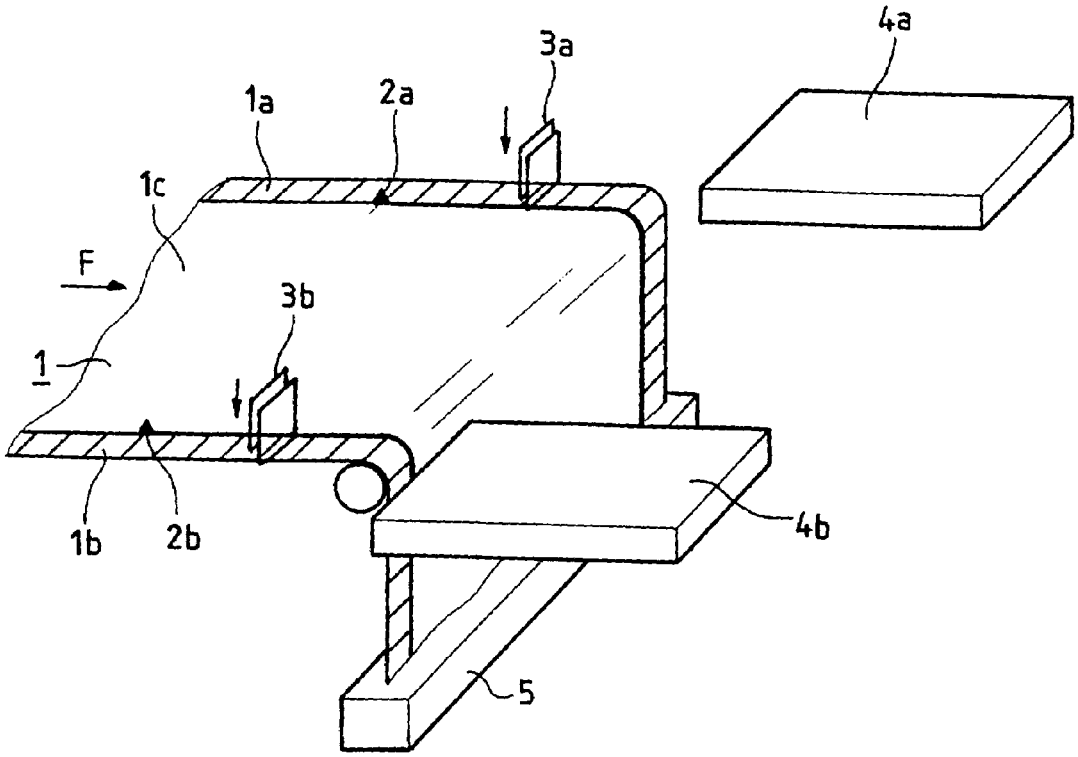
FIGS. 3*a* and 3*b* show a perspective view and a top view, respectively, of an apparatus according to one embodiment of the invention, the edges being cut off transversely.
Figure 3B:
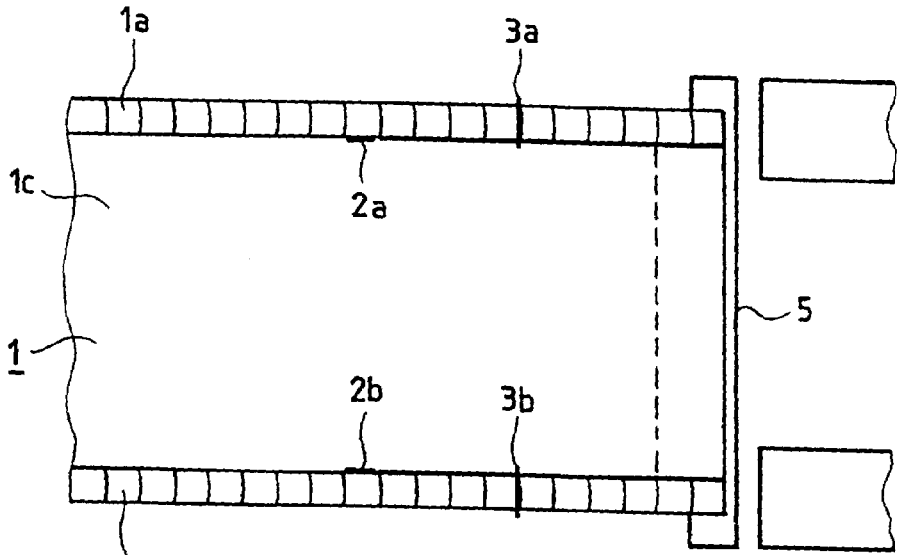

At a selected moment t1_t0, as can be seen from FIGS. 3*a* and 3*b*, the edges 1*a*, 1*b* are cut laterally by the edge cutting means 3*a*, 3*b*. The cut is performed instantaneously by the two guillotine knifes 3*a* and 3*b*, which are retracted immediately after cutting. The cutting is transverse to the conveyance direction F, preferably perpendicular to it.

Figure 4A:
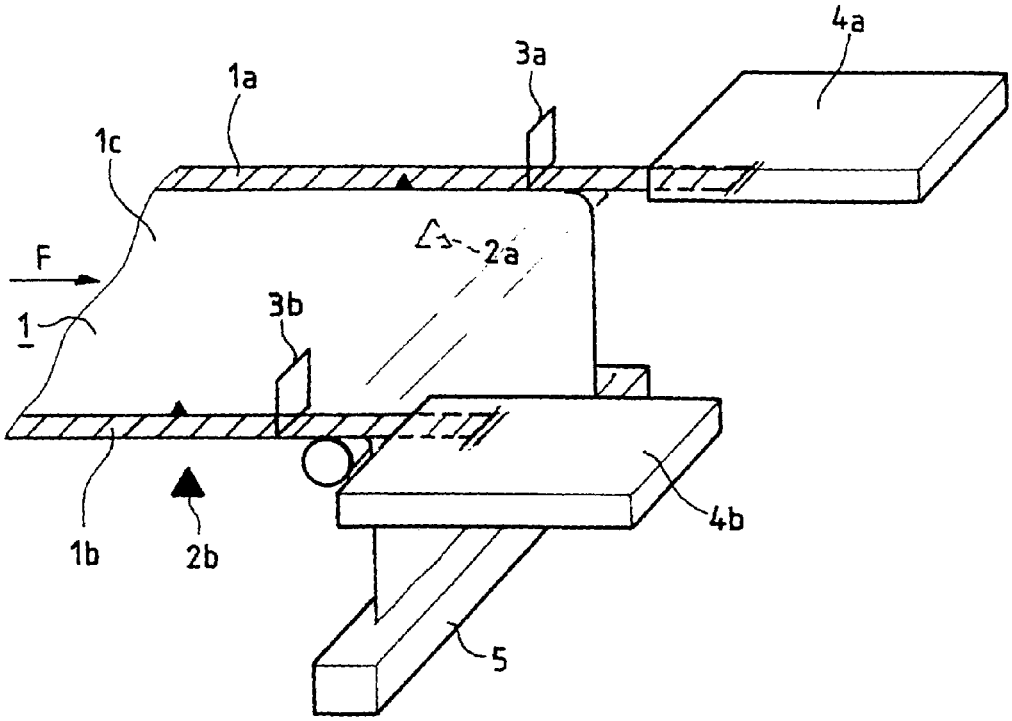
FIGS. 4*a* and 4*b* show a perspective view and a top view, respectively, of an apparatus according to one embodiment of the invention, the edges being taken up by the edge channels.
Figure 4B:
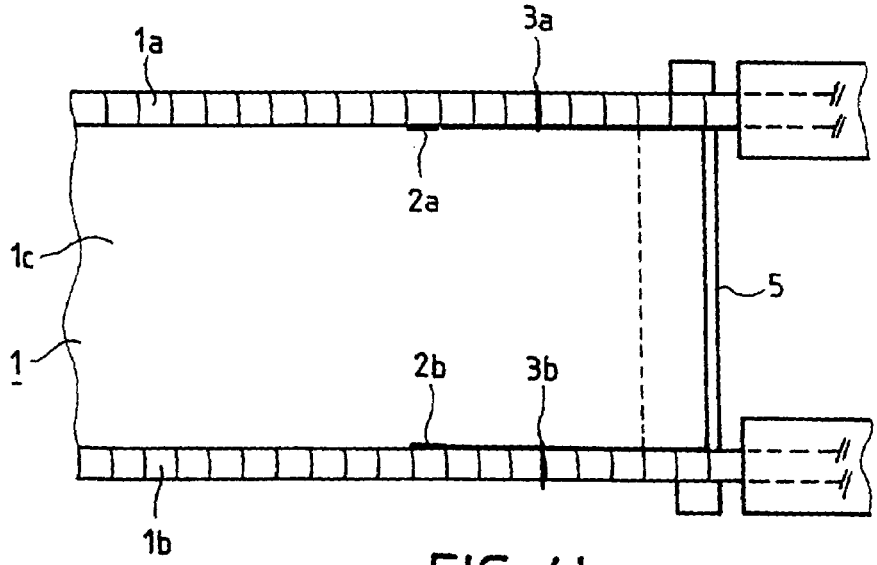

At a further moment t2_t1, as can be seen from FIGS. 4*a* and 4*b*, the edge channels 4*a* and 4*b* are activated to take up the cut edges. At this time the central portion 1*c* of the web continues to fall into the container 5, whereas the cut edges 1*a*, 1*b* are taken into edge channels. The edge channels are "activated" in that sense that suction is initiated, e.g. through sucking means such as air jets arranged along the edge channels. Activation of the edge channels is initiated at a time t2 close to t1, such that the edges that will be taken up are that part of the edges that exit from the oven or stretcher (and not that part falling into the chute).

Figure 5A:
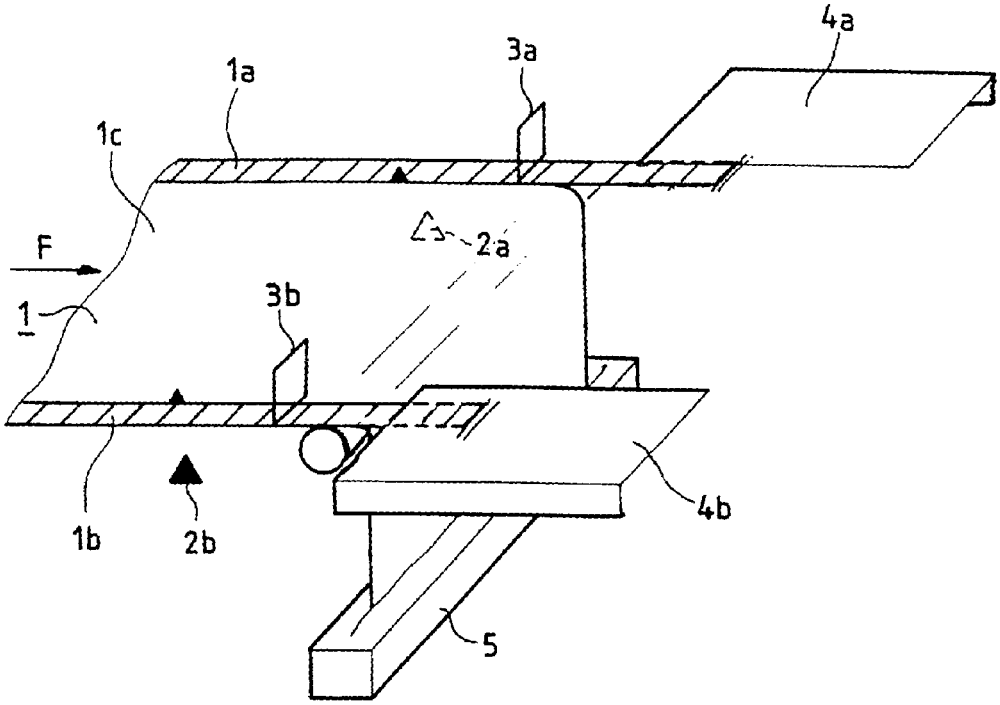
FIGS. 5*a* and 5*b* show a perspective view and a top view, respectively, of an apparatus according to one embodiment of the invention, the edges being secured in the pulling device and the channels in open position.
Figure 5B:
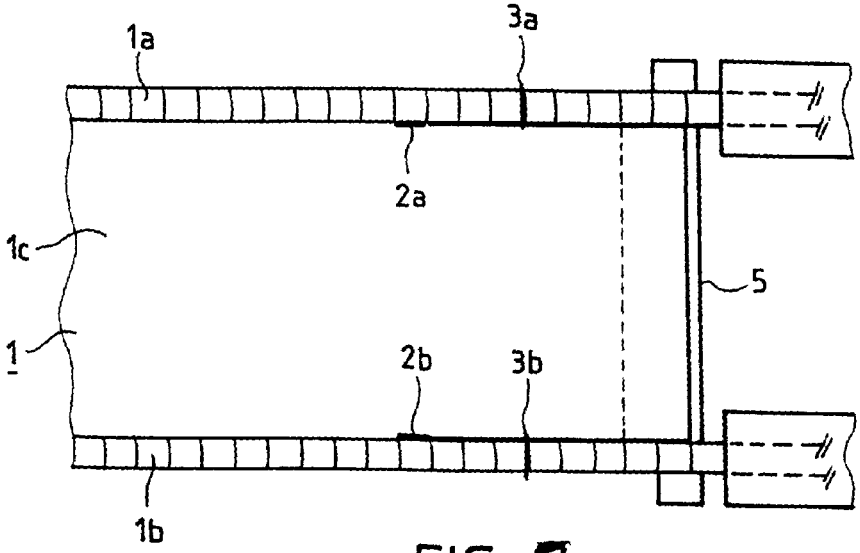

At a moment t3_t2, as can be seen from FIGS. 5*a* and 5*b*, the edges are securely fed into the edge channels, or preferably are securely fed into a pulling unit situated at the other extremity of the processing line 13. At that time when the edges are secured in the pulling unit, one could be sure that the edges will then efficiently perform their role of "entrainer", i.e. they will entrain the central part of the web into the winding unit. At that time, the lids of the edge channels are open, releasing the edges. The edge channels are represented on the figs. without the bottom and inner parts thereof for the sake of understanding, representing the "open position" or "releasing position" of the channels. The edges may then "fall" on another film path, situated below the channels, such as the film path of the processing line 13 from which the web will be further handed.

At a moment t3'_t3, the channels may be retracted, if necessary, e.g. to allow the processing line to freely operate.

Figure 6A:
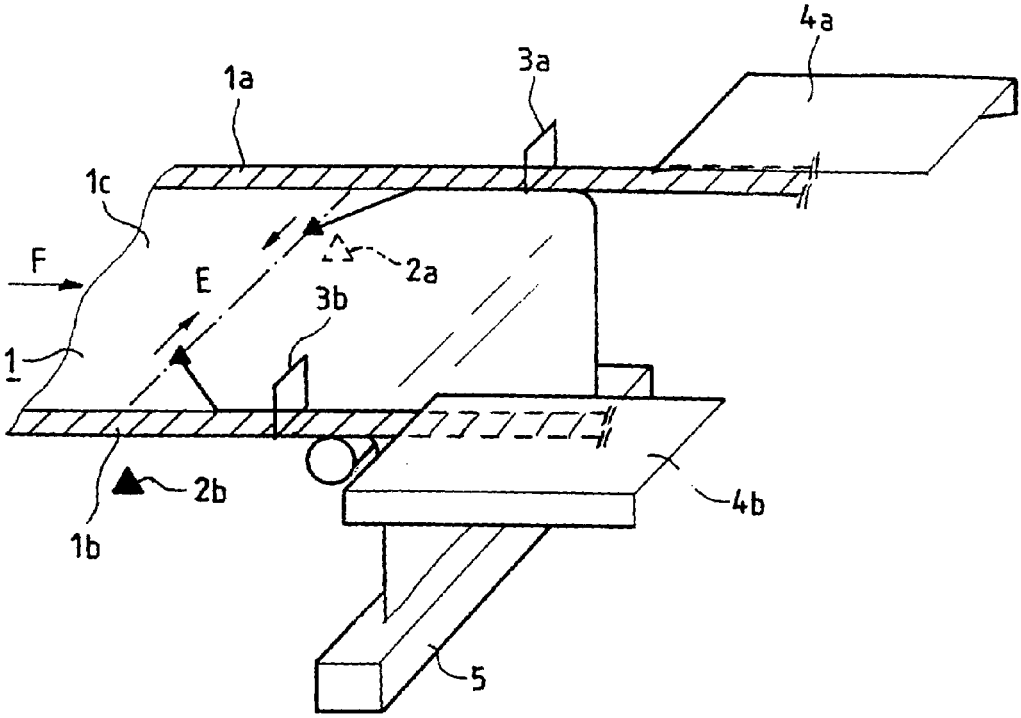
FIGS. 6*a* and 6*b* show a perspective view and a top view, respectively, of an apparatus according to one embodiment of the invention, the central portion being cut transversely.
Figure 6B:
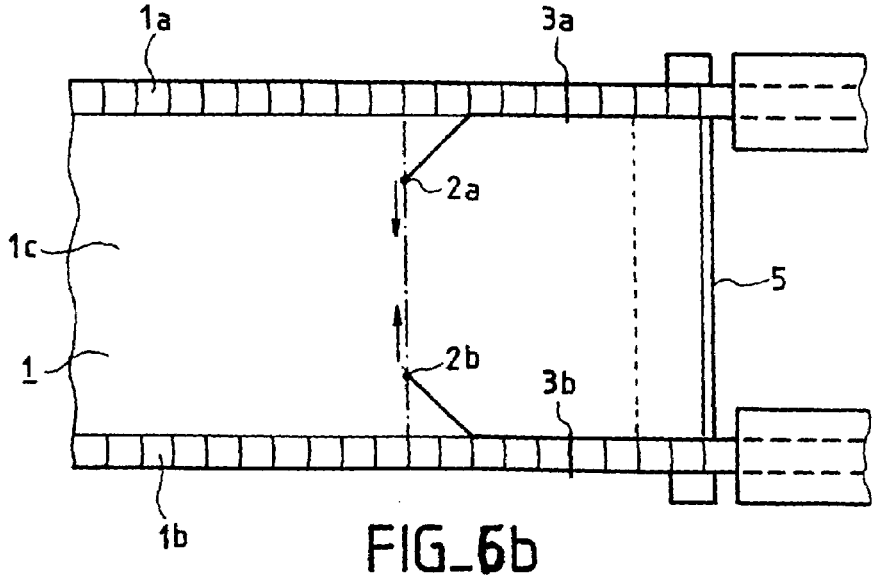

At a moment t4_t3, as can be seen from FIGS. 6*a* and 6*b*, the blades 2*a*, 2*b* start moving along line E in the plane of the web towards each other, in the instant case towards the center of the web, thereby cutting the central portion 1*c* transversely. The blades 2*a*, 2*b* are caused to move transversely to the web conveyance direction at a time where the lids of the channels are open, so as to allow the central part to be entrained between the edges. The attached V-shaped central portion 1*c* is then fed into the winding unit thanks to the protruding edges 1*a*, 1*b*, since these have been secured in the winding unit (e.g. through a driving roll 11 acting as pulling device, and can securely entrain the central part of the web into the winding unit.

Figure 7A:
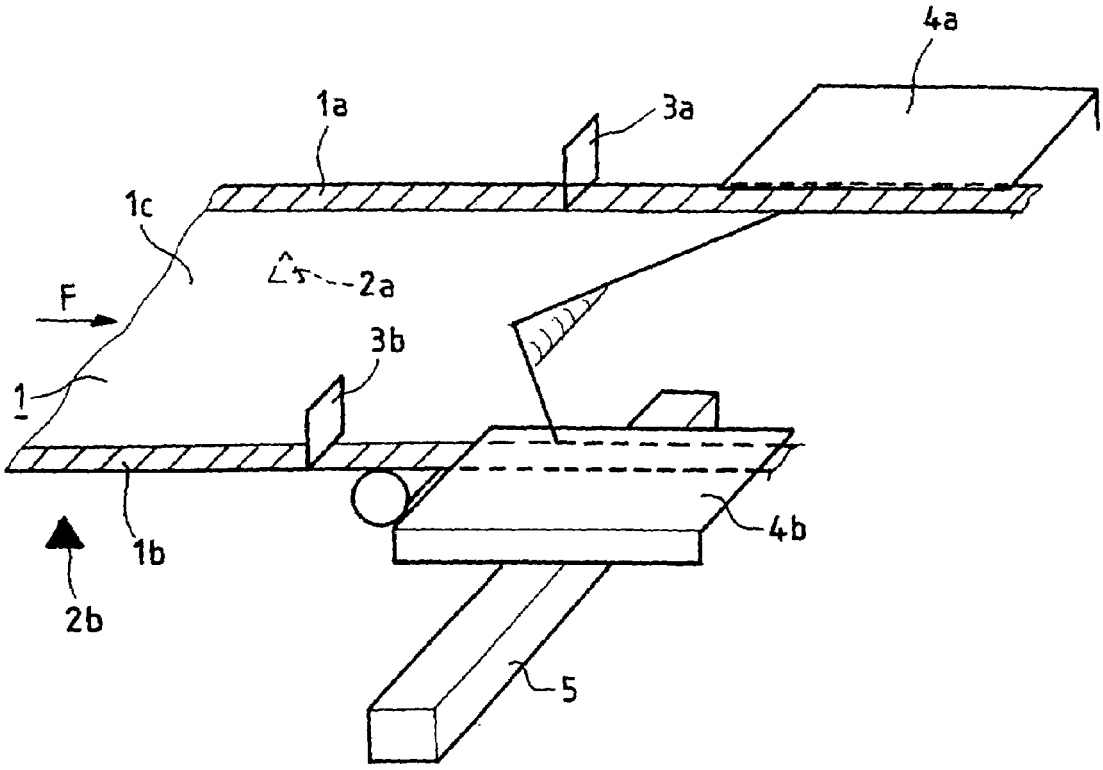
FIGS. 7*a* and 7*b* show a perspective view and a top view, respectively, of an apparatus according to one embodiment of the invention, the central portion being cut transversely up to the meeting point in the middle of the central part, and the central portion being taken in by the edge channels and fed to the processing line.
Figure 7B:
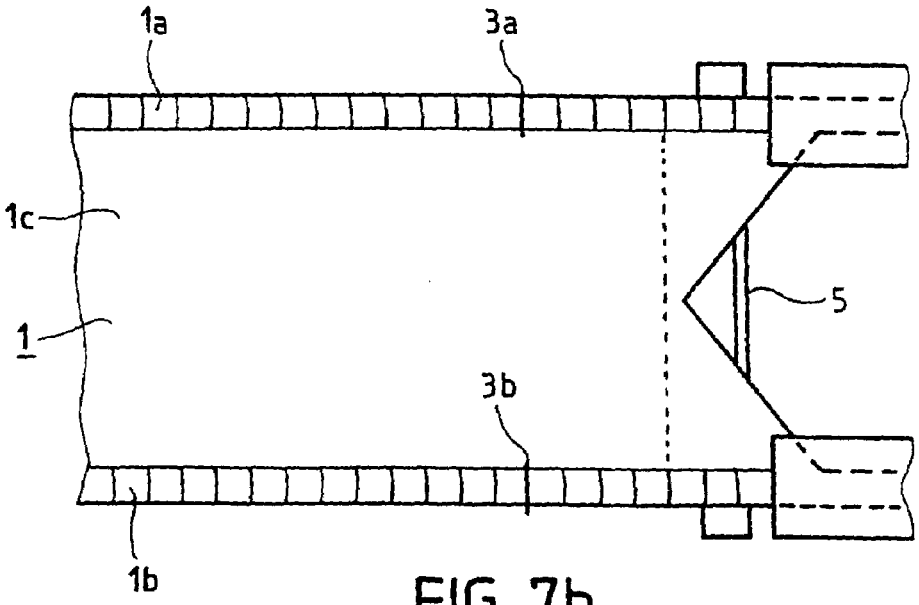

At the moment of arrival of both blades in the center of the web, as can be seen from FIGS. 7*a* and 7*b*, the blades are withdrawn in position below the web to achieve a non-cutting state preventing further cutting of the central portion. The blades are then moved to their initial position below the web near the edges. The result of the operation of the blades 2*a*, 2*b* leads to a V-shaped transverse cut of the central part while the edges protrude in conveyance direction F. The angles have been exaggerated for sake of understanding; given the speed of the line, the angle of the cut piece shall be very acute. In that configuration, it shall be understood that the steps represented FIGS. 6 and 7 will be somehow "fused" together.

The edge cutting means and the central cutting means can be placed along the same line perpendicular to the conveyance direction, or they can be placed at different locations, preferably the edge cutting means (guillotine knifes 3*a*, 3*b*) are located downstream with respect to the central part cutting means (blades 2*a*, 2*b*). The guillotine knifes (3*a*, 3*b*) are preferably placed upstream with respect to the edge channels.

The sequence of the cutting and taking up steps and hence the moments in time t0, t1, t2, t3 and t4 can be varied, as will be appreciated by the skilled man. For example, activation of the guillotine knifes should preferably be such that the latter be activated at a point of time where the web passing at the location of the guillotine knifes is already cut by the blades into its central part and its edges. Activation of the guillotine knifes and the edge channels may be coupled, i.e. they can be activated at the same time or at times separated by a set time-period. The moving of the blades 2*a*, 2*b*, for transverse cutting of the central portion, may be commanded by the activation (opening) of the lids of the edge channels, optionally after a set time-period. Also, and preferably, the activation of the blades should be commanded by the detection of the secured feeding of the edges into the pulling device.

It is also possible to proceed with one edge at a time. In that case, one edge will be first secured in the pulling device, the lid of the first channel will be open, then the second edge will be secured in the pulling device, and only by then the blades 2*a* and 2*b* will be moved towards each other. It is also possible to proceed with one edge only.

Second Embodiment (and Best Mode)

The second embodiment is given with respect to that embodiment where each edge is handled separately. Of course, the second embodiment can be worked out with both edges handled simultaneously.

Figure 8A:
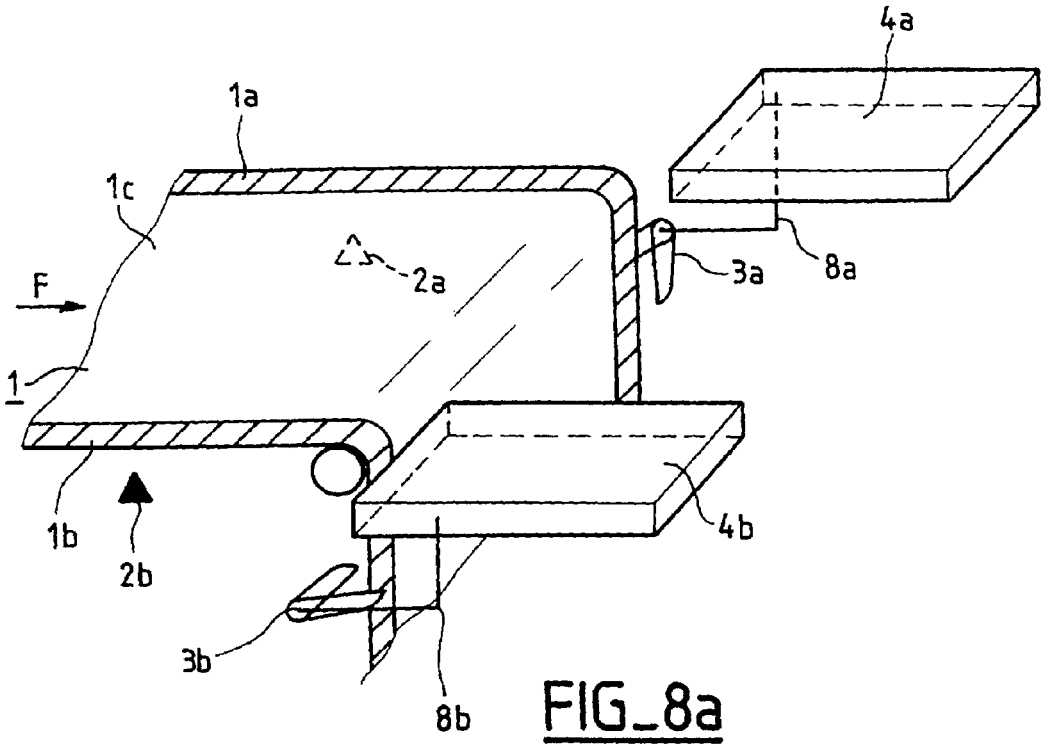
FIGS. 8*a* and 8*b* show a perspective view and a top view, respectively, of an apparatus according to another embodiment of the invention, the web not being cut at all.
Figure 8B:
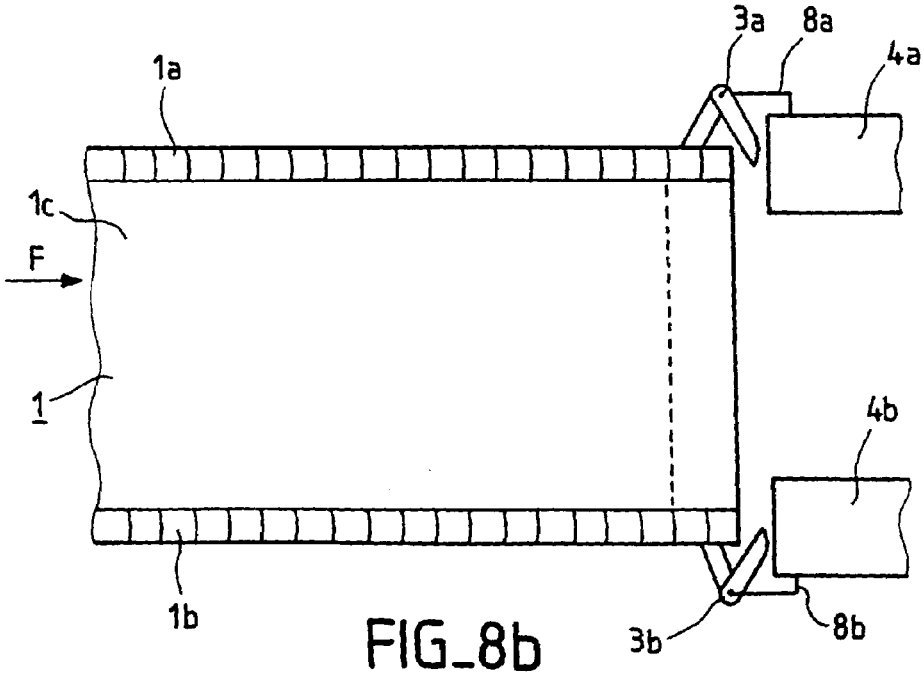

In the apparatus according to the invention as shown in FIGS. 8*a* and 8*b* a web 1 is as in the first embodiment. On its way along conveyance direction F the web 1 passes a central cutting means comprising two sharpened blades 2*a*, 2*b*. In the initial condition shown in FIGS. 8*a* and 8*b* the blades are in a lower position not cutting the web. Downstream in the conveyance direction F, in the vicinity of the roll diverting the web into the chute 5, are located edge channels 4*a*, 4*b* and further downstream are located the edge cutting means in the form of two shears 3*a*, 3*b*. In the second embodiment, the edge channels and the shears are mounted jointly through a carriage 8*a*, 8*b*. The carriage 8*a*, 8*b*, allows for a well-defined placement of the edge channels with respect to the exiting web, in all three directions. The carriage 8*a*, 8*b*, will only be represented in FIGS. 8*a* and 8*b*, and will not be represented in the following. In the present initial condition the shears are in a stand-by state (open position) not cutting the edges 1*a*, 1*b*. The edge channels 4*a*, 4*b* are not activated in the initial condition shown in FIGS. 8*a* and 8*b* and the entire web 1 is falling into the container or chute, which will no longer be represented in the figures in relation with the second embodiment.

Figure 9A:
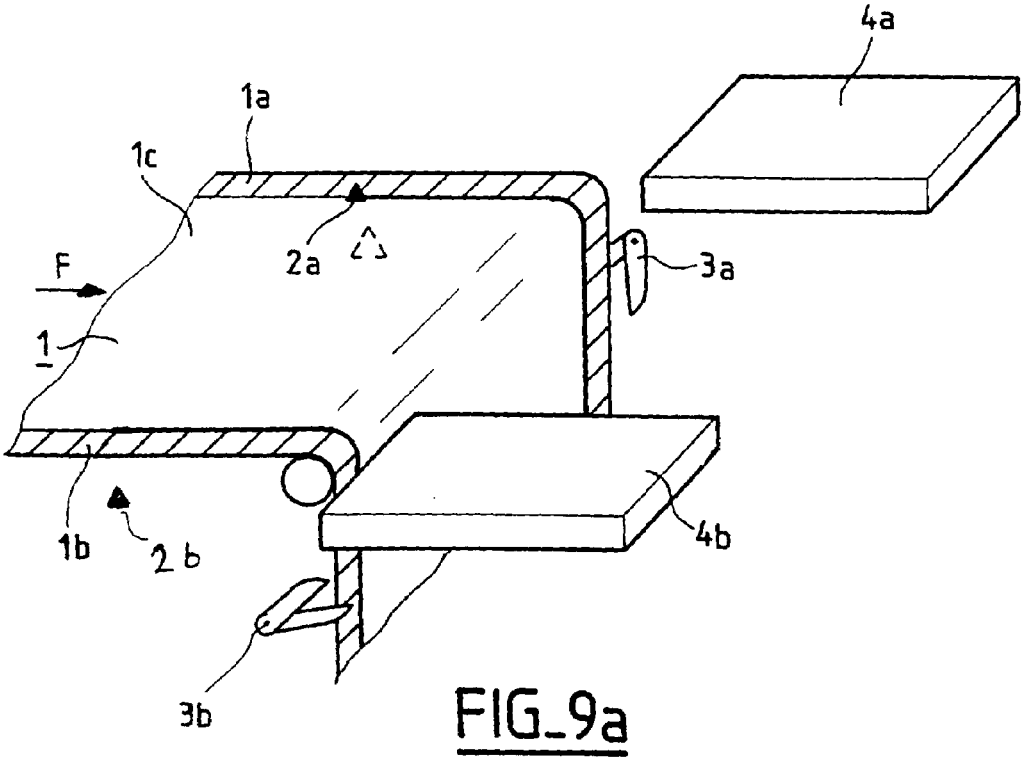
FIGS. 9*a* and 9*b* show a perspective view and a top view, respectively, of an apparatus according to another embodiment of the invention, one edge being cut off laterally from the central portion of the web.
Figure 9B:
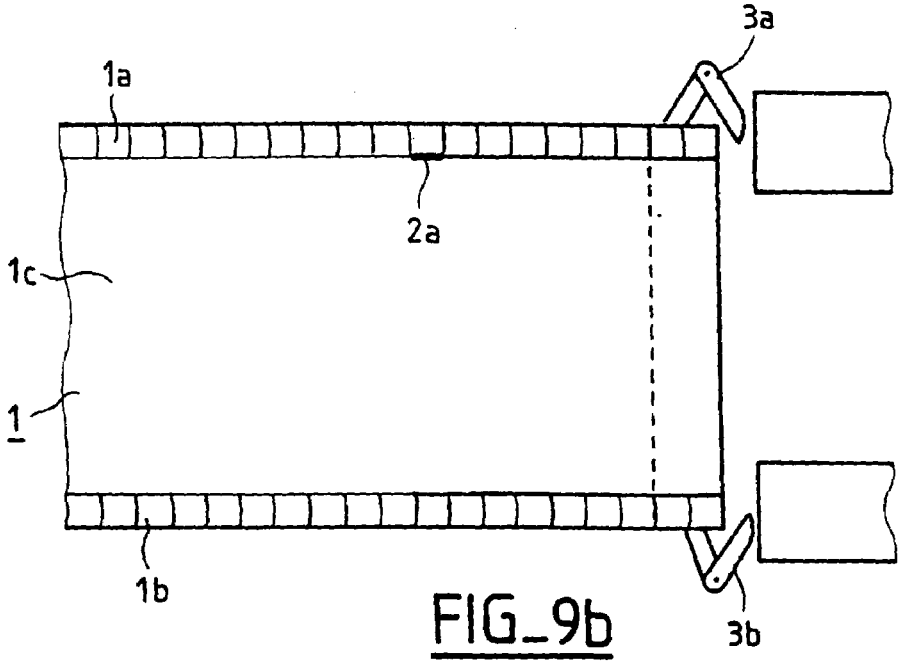

In operation the apparatus according to the second embodiment functions as follows:

At a given moment t0*a*, as can be seen from FIGS. 9*a* and 9*b*, the blade 2*a* is lifted to a position where it protrudes through the web between the edge and the central portion thus cutting the web into said central portion 1*c* and one edge 1*a*. In this position the blade is not moved in the plane of the web, therefore being in a non-moving state. Downstream of the blade the central portion and the separated edge continue to fall into the container 5.

Figure 10A:
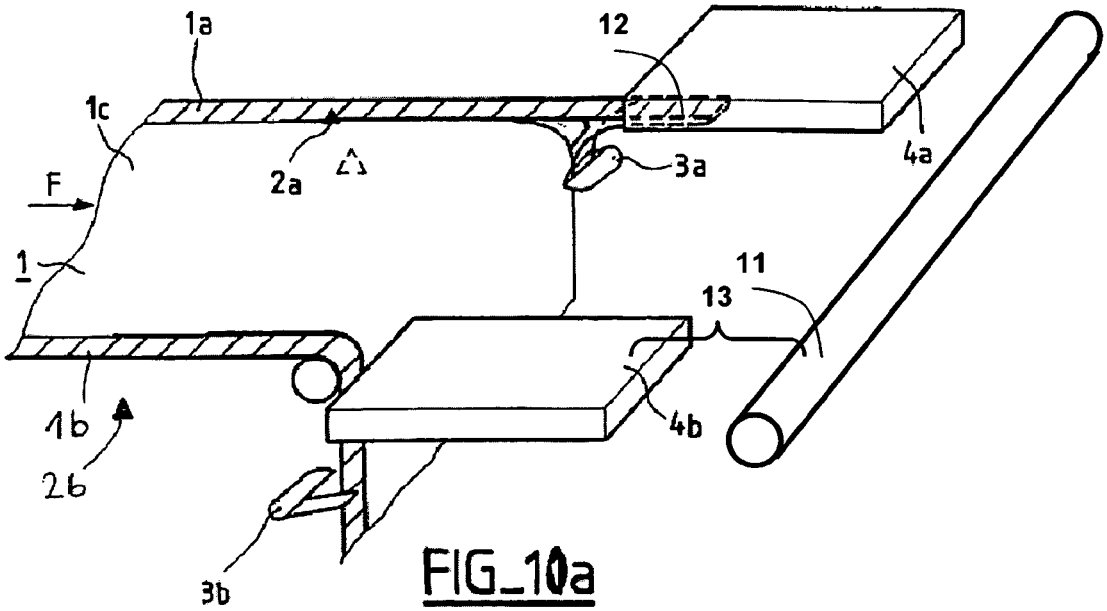
FIGS. 10*a* and 10*b* show a perspective view and a top view, respectively, of an apparatus according to another embodiment of the invention, where the edge channels are activated and the shears knife are also activated, for one given edge, whereby said edge forms a loop within the respective edge channel.
Figure 10B:
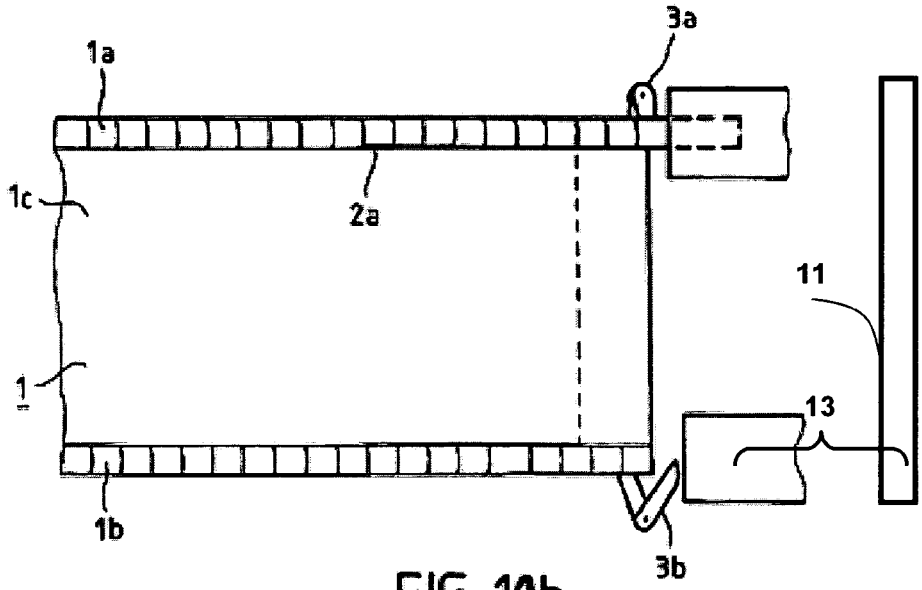

At a moment t1*a*_t0*a*, as can be seen from FIGS. 10*a* and 10*b*, the edge 1*a* is cut laterally by the shears 3*a*. The cutting is not performed instantaneously as in the first embodiment, but will have a duration until moment t2*a*. During that interval of time (t2*a*–t1*a*), the edge is "blocked" at the shears level, and since the film is still coming out from the oven or stretcher, a loop will build up with the incoming edge. The channel being activated, e.g. by suction means (not represented), the loop will form into the channel. The loop 12 is represented by the dotted line and may extend into the channel by a distance that can be varied up to one meter or less or more. For example, (t2*a*–t1*a*) can be about 0.1 s, the speed of the film can be 5 m/s, thus the loop will have a length of 0.25 m. The suction means are not represented here but are conventional (see first embodiment).

Figure 11A:
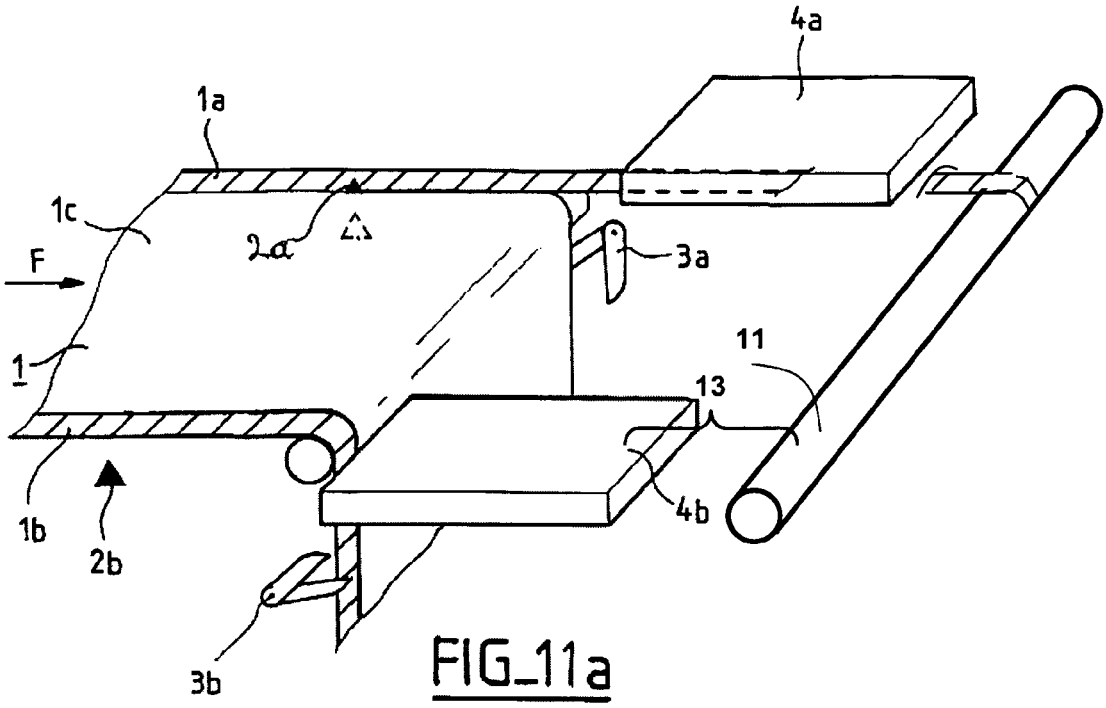
FIGS. 11*a* and 11*b* show a perspective view and a top view, respectively, of an apparatus according to one embodiment of the invention, one edge being taken up by one edge channel.
Figure 11B:
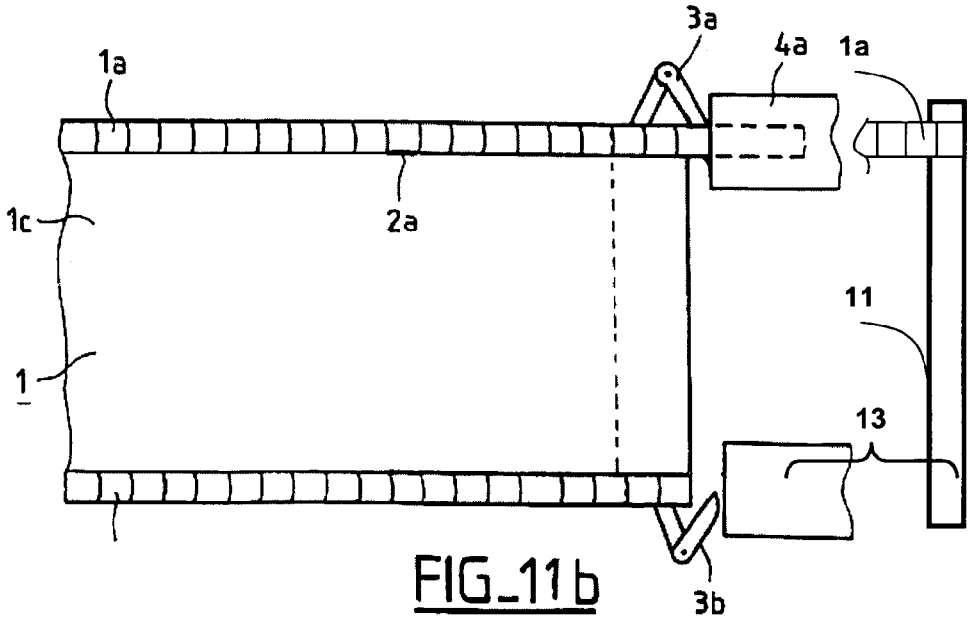

At a moment t2*a*_t1*a*, as can be seen from FIGS. 11*a* and 11*b*, the edge 1*a* is finally cut by the shears 3*a*. The edge channel takes up (here sucks) the cut edge 1*a*. At this time the central portion 1*c* of the web and the edge 1*b* to which it is still attached continue to fall into the container 5. The edge channel is "activated" in the same sense as above (activation may be varied or not during transport of the edge). The edge 1*a* is then secured in the pulling device (not shown) or any other equivalent means of the driving unit.

Figure 12A:
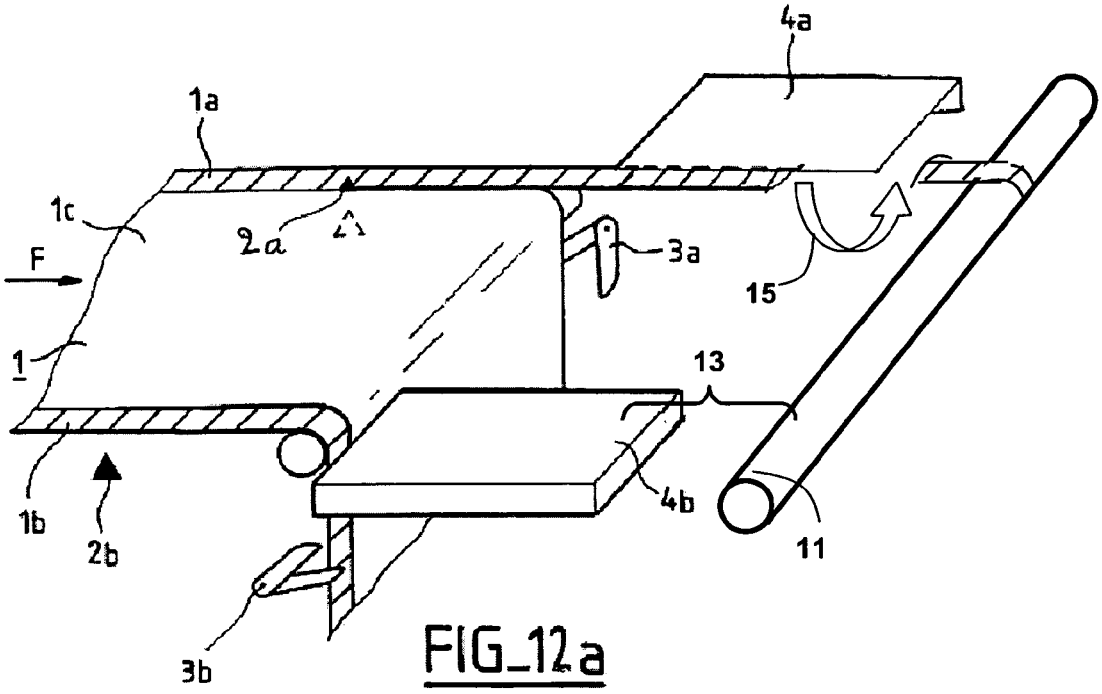
FIGS. 12*a* and 12*b* show a perspective view and a top view, respectively, of an apparatus according to another embodiment of the invention, the one edge being taken up by the edge channels and secured in the pulling device.
Figure 12B:
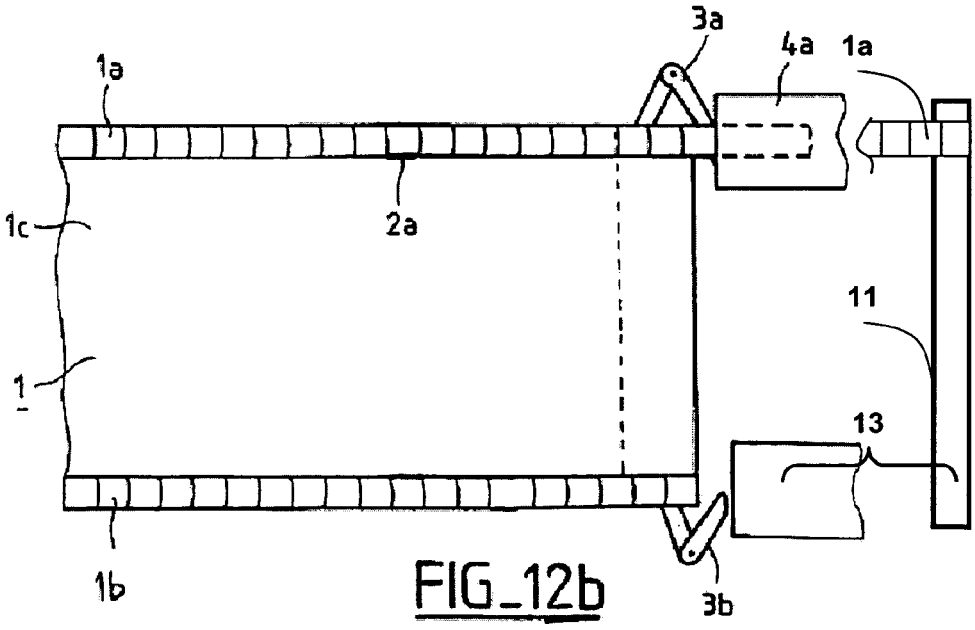
Figure 13A:
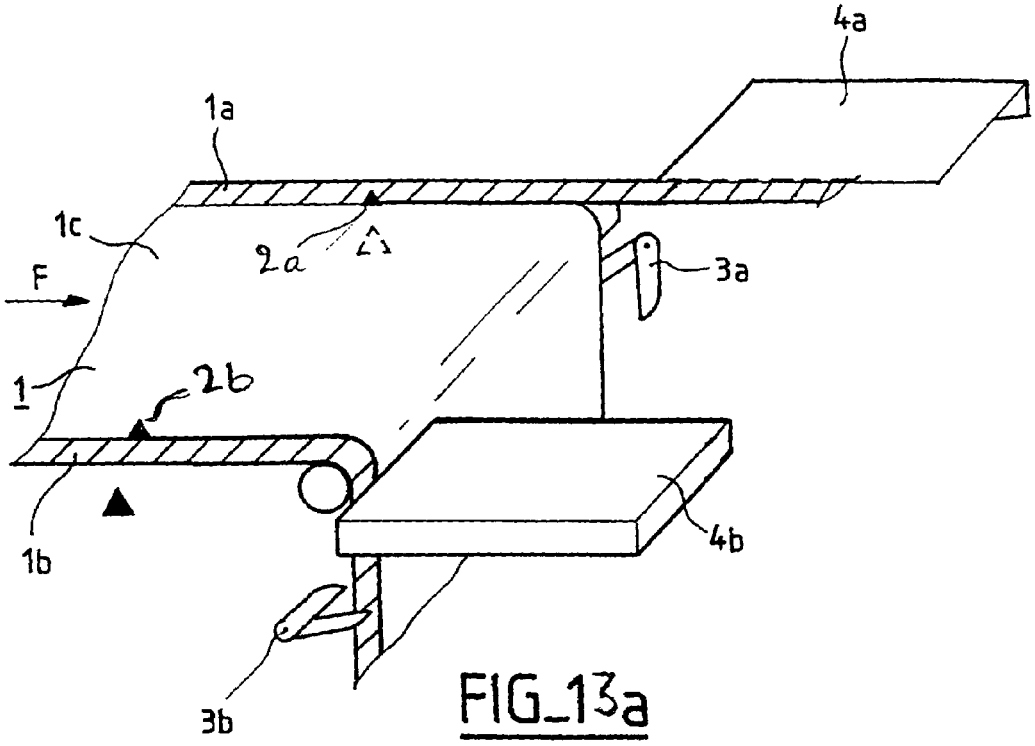
Figure 13B:
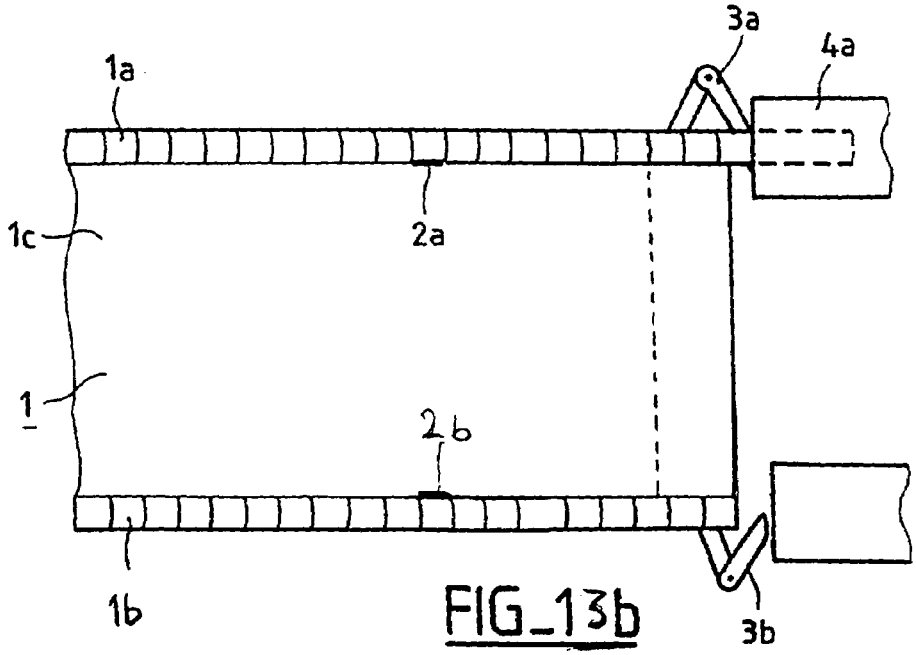
Figure 14A:
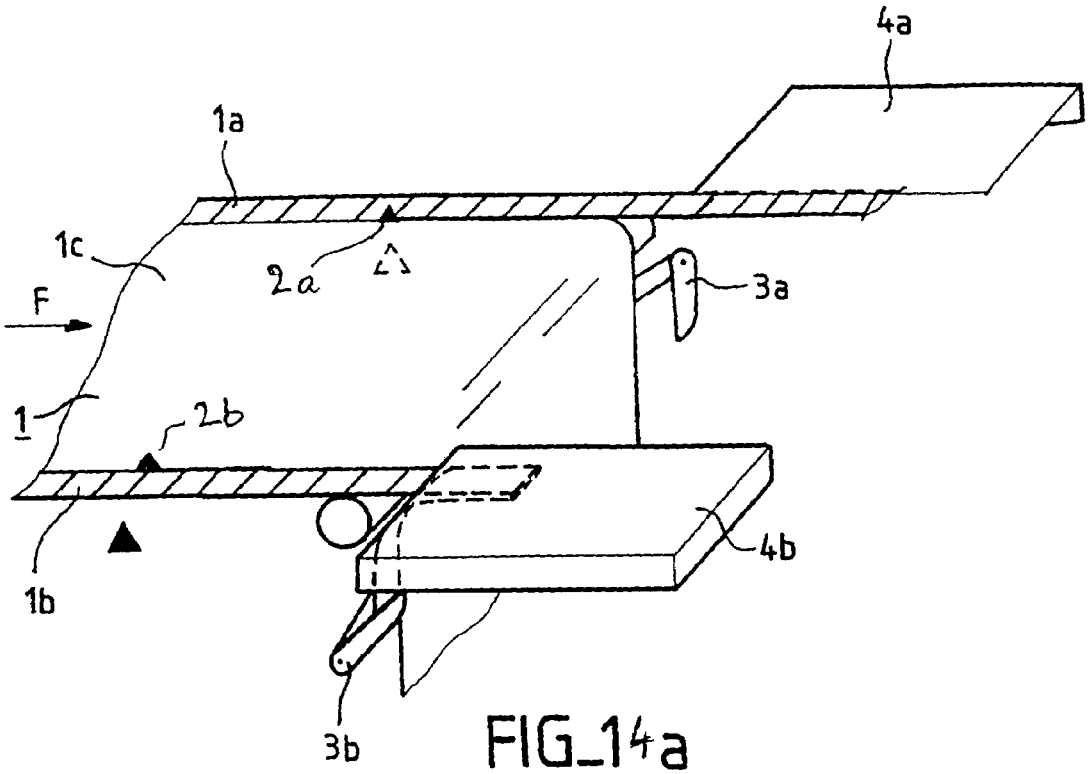
Figure 14B:
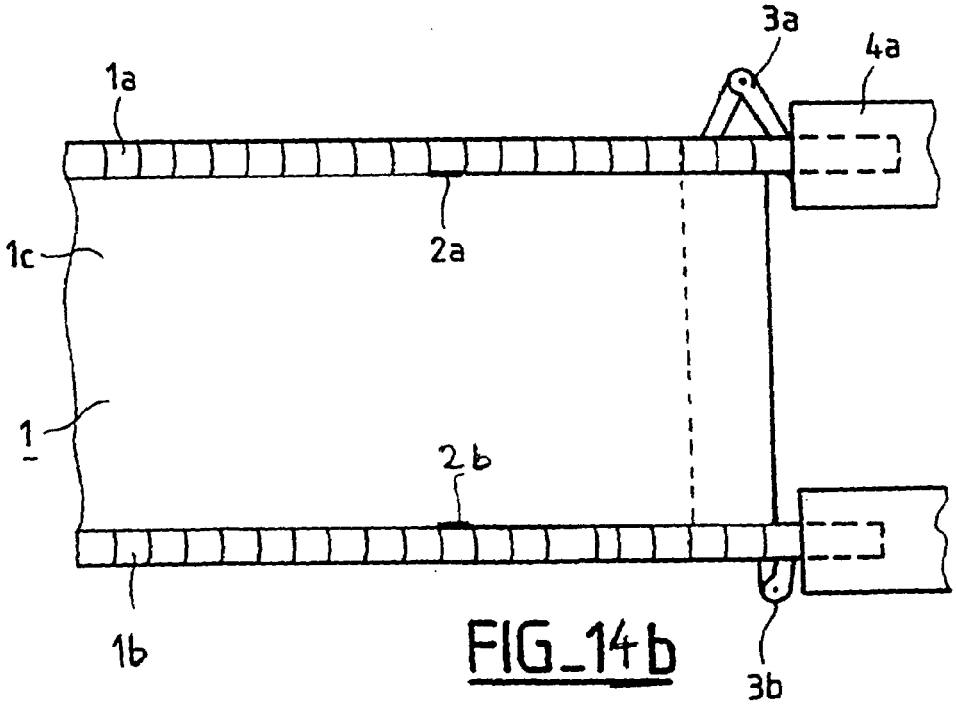
Figure 15A:
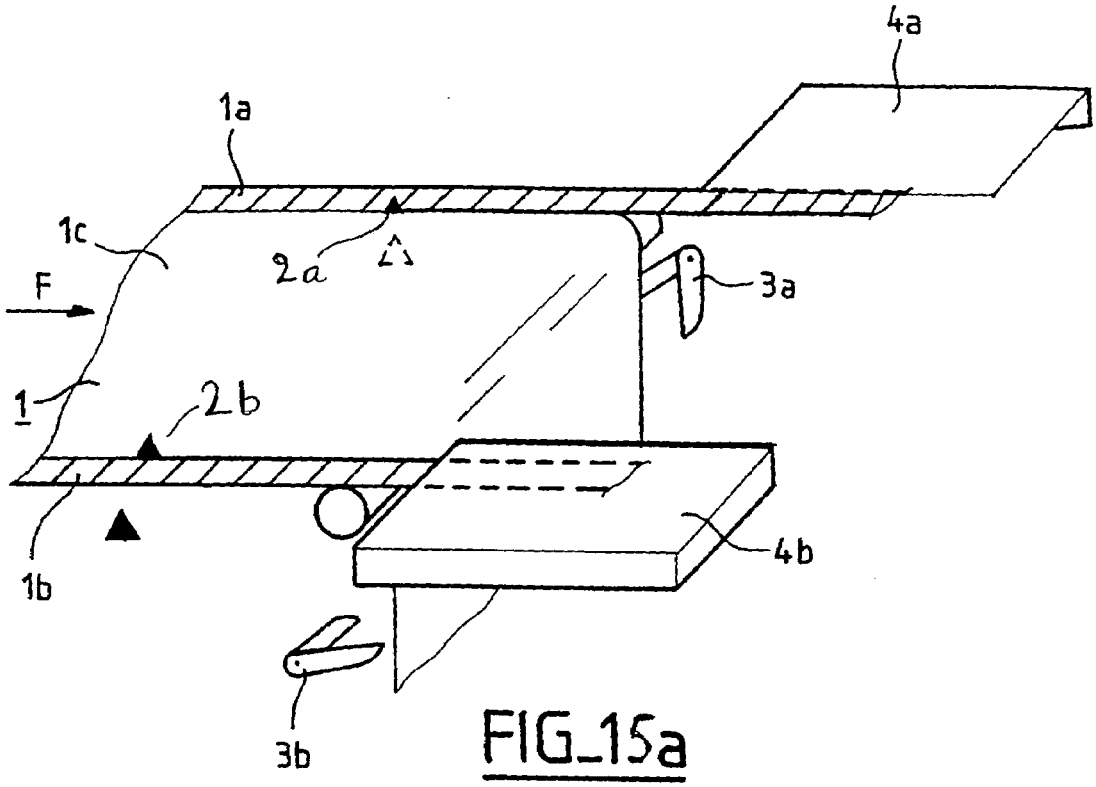
Figure 15B:
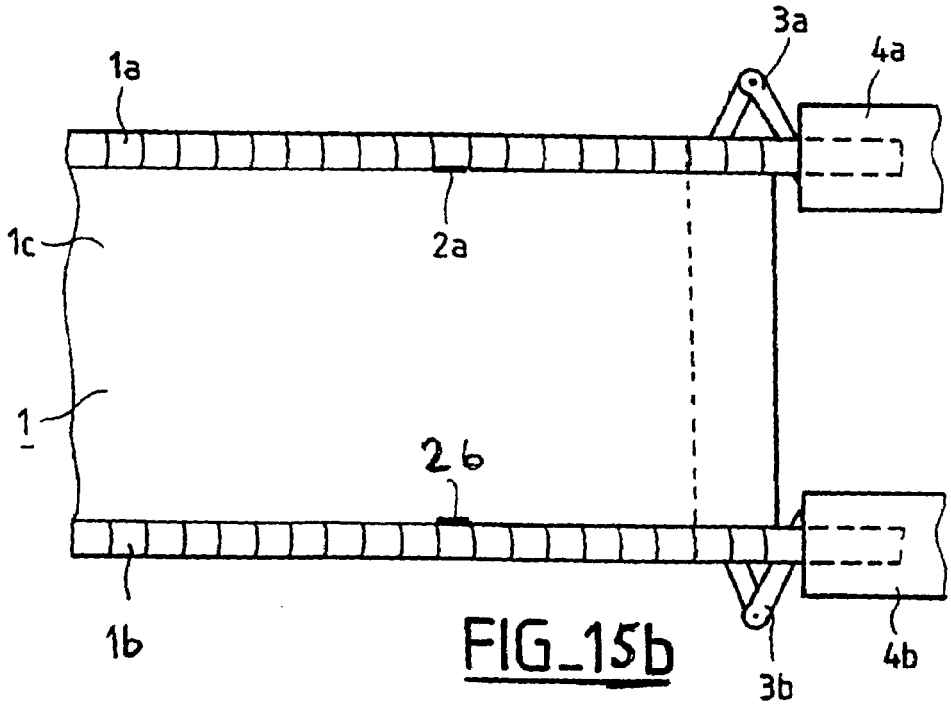
Figure 16A:
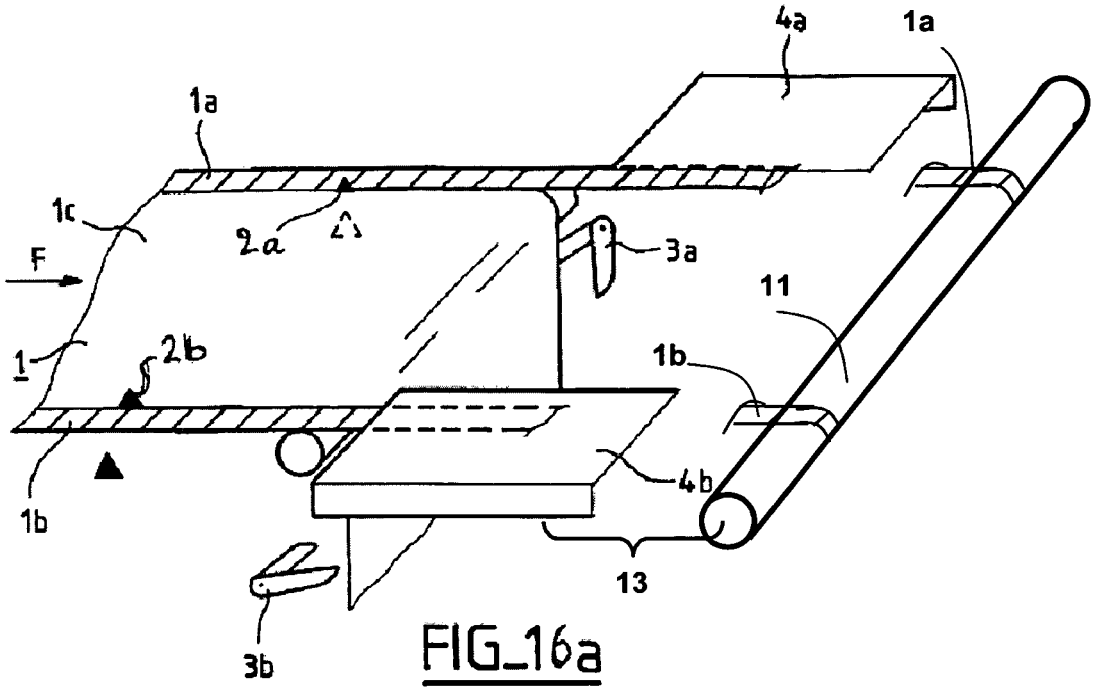
Figure 16B:
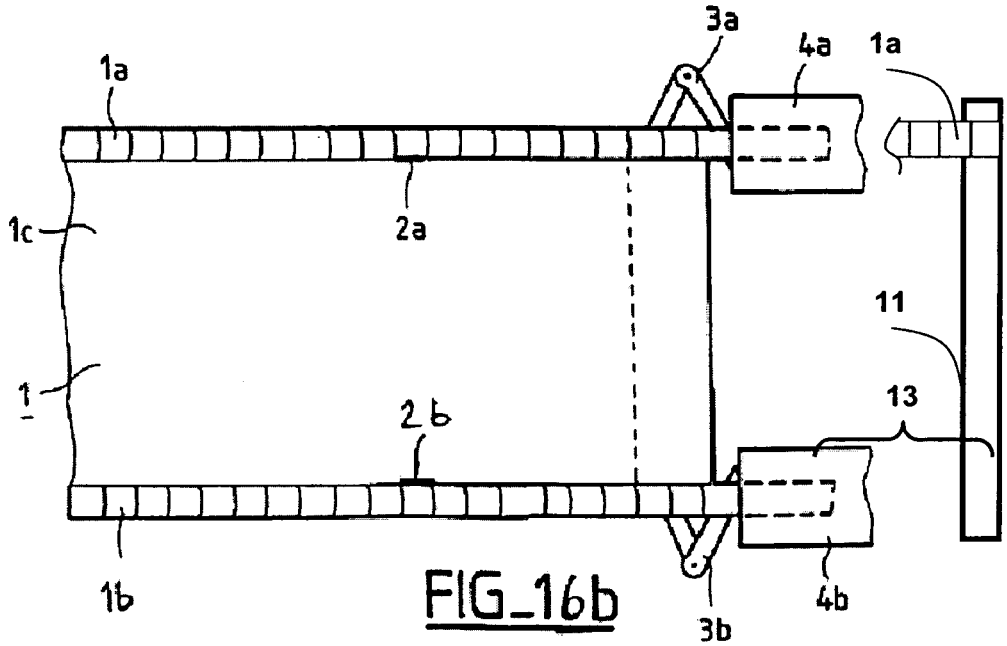
Figure 19:
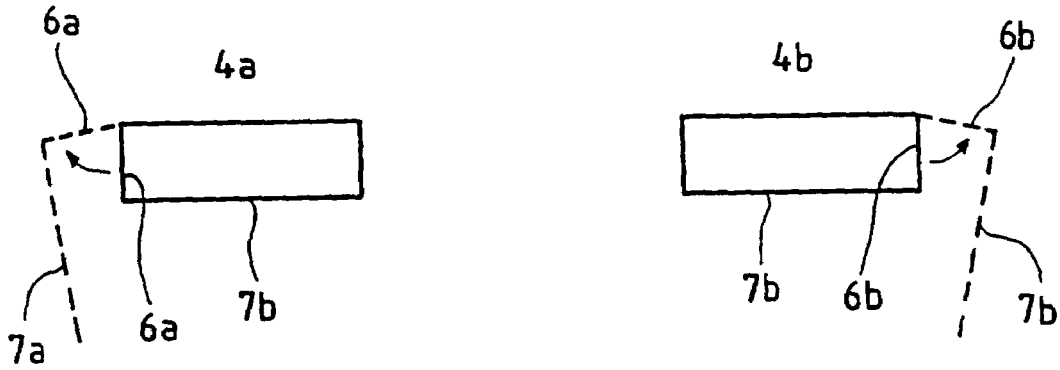
FIG. 19 shows a cross-sectional view of a preferred edge channels in the form of a edge channel with rotatable half-part.

At a further moment t3*a*_t2*a*, as can be seen from FIGS. 12*a* and 12*b*, the lids of the edge channel 4*a* are open 15, releasing the edge; in fact the bottom and inner parts of the edge channels are not represented for the sake of understanding; further details can be seen on FIG. 19. As in the first embodiment, the edge may "fall" onto another film path, and the channel 4*a* may be retracted.

The same sequence as above is then initiated for the other edge, at varying times t0*b*, t1*b*, t2*b*, t3*b* and t4*b*, and is illustrated in FIGS. 13*a* to 16*b*. At the end of the second sequence, the situation is the following: the two edges are transported through the processing line and secured in a pulling device situated at the other extremity, and they are ready to perform their role of entrainer.

It should be noted that the lids of the channel 4*a* can be open before the sequence for edge 1*b* starts, or it can be open after the sequence is completed, e.g. simultaneously with the lid of channel 1*b*. Also, the channels may be retracted if needed by the operation of the processing line (transport rolls to be moved at given positions, etc.).

Figure 17A:
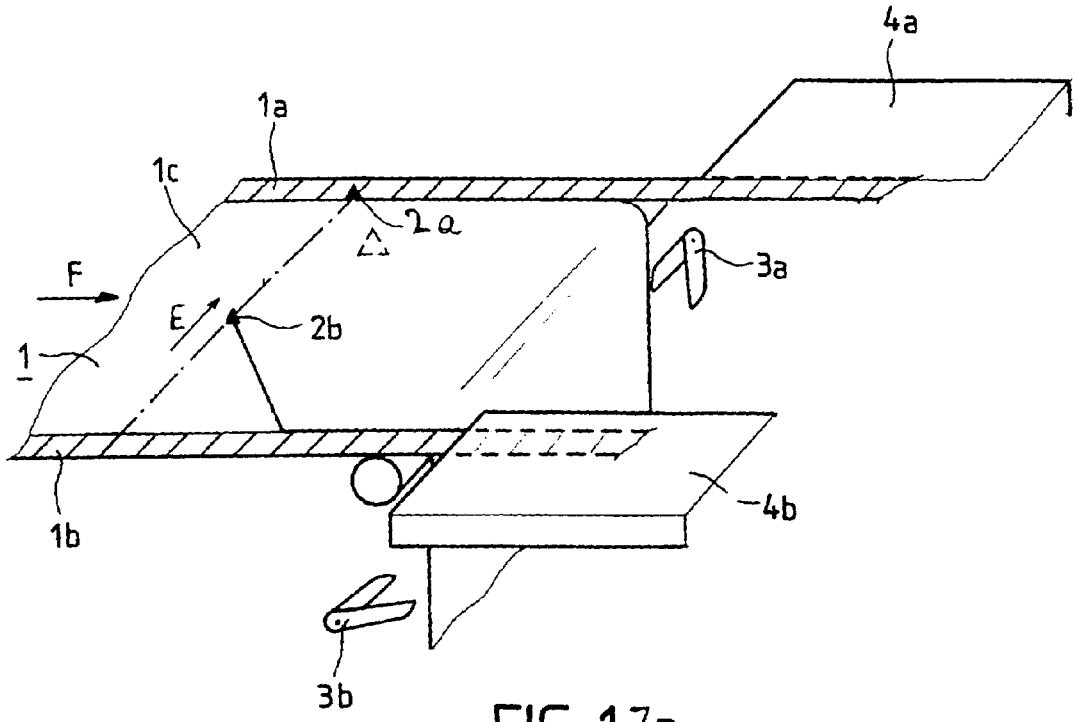
FIGS. 17*a* and 17*b* show a perspective view and a top view, respectively, of an apparatus according to another embodiment of the invention, the central portion being cut transversely.
Figure 17B:
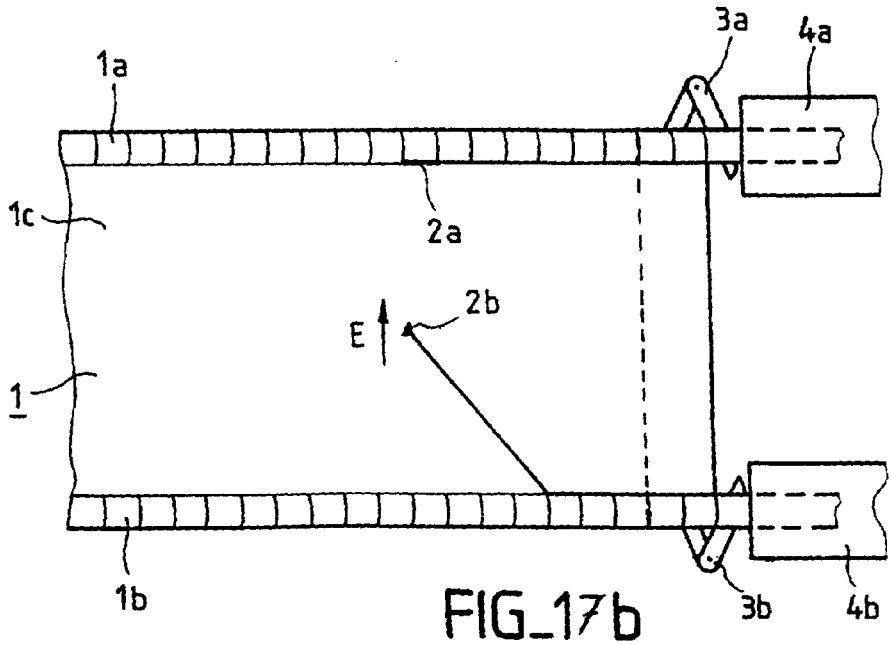

At a moment t5_t4*a*/t4*b*, as can be seen from FIGS. 17*a* and 17*b*, the blade 2*b* starts moving along line E in the plane of the web towards blade 2*a*, thus creating a movement of the blades towards each other, thereby cutting the central portion 1*c* transversely. The blade 2*b* is caused to move transversely to the web conveyance direction at a time where both edge channels are open. The open state is of course required for allowing the central part of the film to be fed into the winding unit (otherwise the tube-like channels would prevent the central part from being conveyed).

Figure 18A:
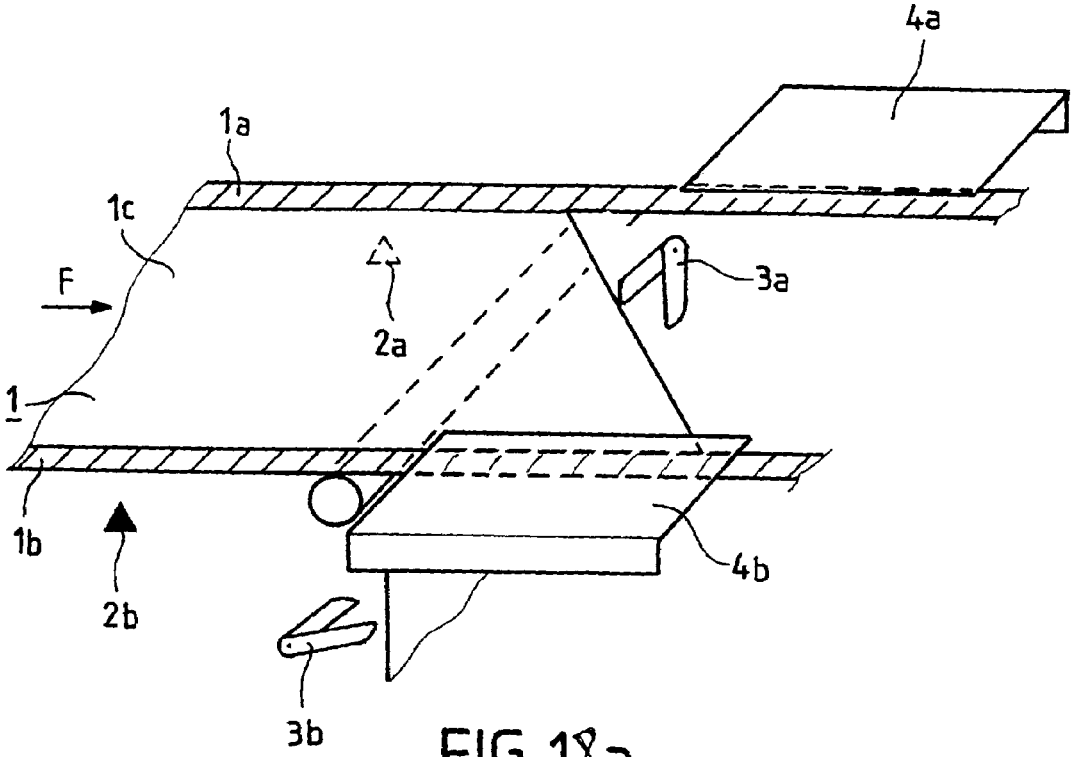
FIGS. 18*a* and 18*b* show a perspective view and a top view, respectively, of an apparatus according to another embodiment of the invention, the central portion being taken in by the edge channels and fed to the processing line.
Figure 18B:
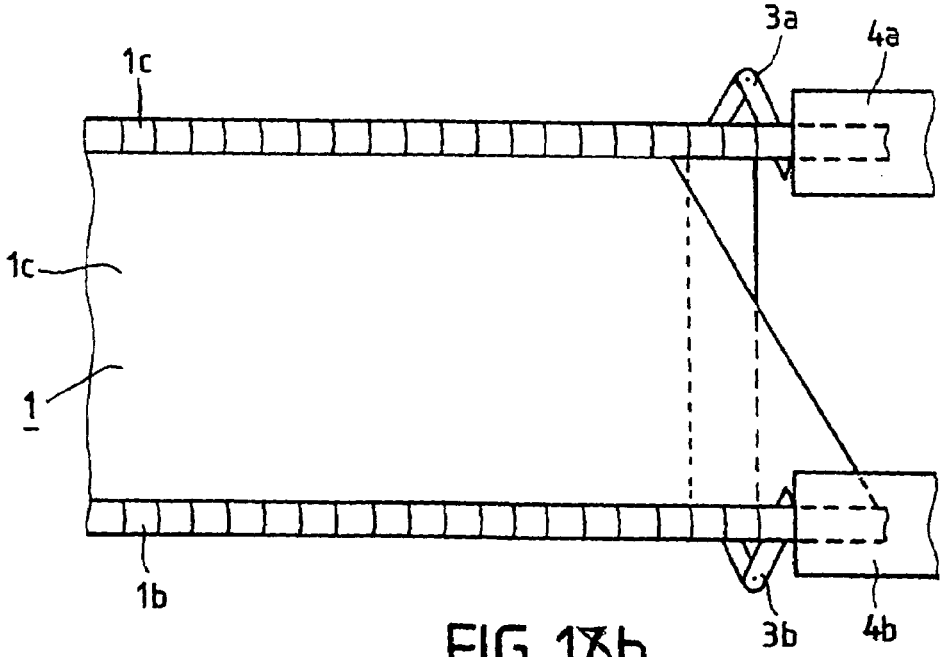

In the moment of arrival of blade 2*b* at the location of blade 2*a* at the border of the central part of the web, as can be seen from FIGS. 18*a* and 18*b*, the blades are withdrawn in position below the web to achieve a non-cutting state preventing further cutting of the central portion. The blades are then moved to their initial position below the web near the edges. The result of the operation of the blades 2*a*, 2*b* leads to a N-shaped transverse cut of the central part while the edges protrude in conveyance direction F. The attached N-shaped central portion 1*c* is then fed into the processing line thanks to the protruding edges 1*a*, 1*b*, acting as "entrainer". As indicated in the first embodiment, the angles have been exaggerated for sake of understanding; given the speed of the line, the angle of the cut piece shall be very acute. In that configuration, it shall be understood that the steps represented FIGS. 17 and 18 will be somehow "fused" together.

As shown, the edge cutting means (shears 3*a*, 3*b*) are located downstream with respect to the central part cutting means (blades 2*a*, 2*b*). The shears (3*a*, 3*b*) are also located downstream with respect to the edge channels.

The sequence of the cutting, loop formation and taking up steps and hence the moments in time t0, t1, t2, t3 etc. can be varied. In the embodiment shown in FIGS. 8*a* to 15*b*, the following sequences can be obtained. Activation of the shears, and consequently formation of the loop should preferably be such that the shears be activated at a point of time where the web passing at the location of the shears is already cut by the blades into its central part and its edges. Activation of the shears and the edge channels may be coupled, i.e. they can be activated at the same time or at times separated by set time-period. The moving of the blade 2*a* (2*b*), for transverse cutting of the central portion, may be commanded by the activation of selected units of the apparatus (shears 3*a*, 3*b*; detection of the secured feeding of said edges into the pulling device; opening of the lids of the channels; retraction of the channels), optionally after a set time-period, preferably at such time immediately before the processing line is in production mode.

The following sequence is also possible:

edge 1*a* is first threaded up as described above;

blade 2*b* is lifted up (nothing else occurs);

blade 2*a* moves towards blade 2*b;* as soon as blade 2*a* reaches blade 2*b*, both blades (2*a*, 2*b*) are withdrawn and shears 3*b* are activated simultaneously. The web central part 1*c* will then entrain the edge 1*b*. Alternatively, shears 3*b* can be replaced with guillotine as in the first embodiment.

FIG. 19 shows a cross-sectional view of the edge channel. As shown, these edge channels (4*a*, 4*b*) can be equipped with a rotatably mounted side comprised of inner and bottom parts 6*a*, 7*a* and 6*b*, 7*b*, respectively, these rotatably mounted sides engaging/releasing the edges. Said rotatably mounted side can be either the inner part, the bottom part or both. In case the rotatably mounted side is the inner part 6*a*, 6*b* (facing each other), the edge channels will be converted into horizontal U-shaped guides, allowing the entire web to be driven between them. The edge channels can then be retracted laterally. In case the rotatably mounted side is the bottom part 7*a*, 7*b* (facing down), the edge channels will be converted into vertical U-shaped guides (with the opening facing down), and in order for the web to be properly conveyed, it will fall at a position situated below the edge channels. The edge channels can then be retracted upwards. Preferably, the rotatably sides may be comprised of both the inner and bottom parts of the edge channels. This latter embodiment is shown in FIG. 19, where the dotted line represents the position where the inner and bottom parts are open. The lids may also be comprised of three sides of the channel. Also, the movable lids may be moved by translation, instead of by rotation. The edge may thus get out upwards, downwards, sidewards or diagonally.

The channels are activated thanks to, e.g. air jets, pneumatically driven. The proper number of air jets is arranged along the channel. The channel need not be of one piece; it can comprise several sub-units which may be spaced or close each to the other. The air jets may be comprised of a Venturi tube arranged at the end of the channel. The Venturi is fed with pressurized air that will entrain ambient air at high speed through the channel, which ambient air will ultimately convey the edge.

The channel edges represented FIGS. 1*a* through 15*b* can be at a level within the conveyance direction F, or they can be oriented with respect to same, either upwards or downwards, and/or they can be shifted upwards or downwards with respect to the web plane. For example, the edge channels can form with the conveyance direction any angle (for from 15 to 30°), upwards, and can be shifted upwards (e.g. according to a vertical position) with respect to the web plane. Also, since the width of the web can be modified, the edge channels are preferably mounted on a carriage that will place them at the appropriate position to accommodate the width of the web, as described in FIGS. 8*a* to 14*a*. The carriage will also preferably carry the cutting knifes (3*a*, 3*b*) when the edge channels and the cutting knifes (e.g. the shears) are mounted jointly.

With a cutting means such as a high speed laser beam or pressurized water beam the placement with respect to the conveyance direction and within the apparatus and the sequence of the cutting steps can be modified appropriately.

While the description has been given with respect to specific embodiments (blades, guillotine, shears, scissors, edge channels), it is clear that the invention is not limited to these embodiments. Also, the two embodiments disclosed can be combined as far as one or more steps are concerned.

While the description has been given with respect to the handling of the two edges, it is clear that the invention can be worked out with only one edge. The skilled man will appreciate any adaptation of the above description to achieve the invention with one edge only.

The invention claimed is:

1. A method for cutting a web conveyed along a conveyance direction, and subsequent feeding and threading it up into a processing line, said web comprising a central portion and edges, the method comprising the steps of:

(i) cutting off at least one edge laterally from the central portion along said conveyance direction;

(ii) cutting said at least one edge along a direction transverse to the conveyance direction;

(iii) taking up said at least one edge into the processing line through edge channel(s) said channel(s) comprising a section substantially closed with movable lids;

(iv) securing said at least one edge in a pulling unit located at along the processing line past said channel(s);

(v) opening the lids of the channel(s) to allow the central portion to be entrained along said conveyance direction into the processing line; and (vi) stopping said lateral cutting of said at least one edge and cutting the central portion transversely to the conveyance direction whereby said edge portion(s) entrain said central portion through said channel(s) into the processing line.

2. Method for cutting and feeding a web according to claim 1, wherein the taking up step (iii) comprises sucking the edges into tube channels.

3. Method for cutting and feeding a web according to claim 1 further comprising the step of forming a loop of edges at the vicinity of the edge channel during step (ii).

4. Method for cutting and feeding a web according to claim 1 wherein both edges are processed.

5. Method for cutting and feeding a web according to claim 4, wherein said both edges are processed simultaneously.

6. Method for cutting and feeding a web according to claim 4, wherein said both edges are processed independently.

7. Method for cutting and feeding a web according to claim 6, wherein said both edges are processed sequentially.

8. Method for cutting and feeding a web according to claim 1, wherein the cutting step (i) comprises a step of keeping the central cutting means at a non-moving state for lateral cutting off the edges from the central portion.

9. method for cutting and feeding a web according to claim 1, wherein the cutting step (ii) comprises a step of instantaneous transversely cutting of the edges.

10. Method for cutting and feeding a web to claim 1, wherein the cutting step (vi) comprises moving the central cutting means towards each other transversely to the conveyance direction.

11. The method according to claim 1 wherein the step of cutting the central portion transversely to the conveyance direction occurs ahead of said channel(s) along the conveyance direction and after said step of securing said at least one edge in said pulling unit.

* * * * *

UNITED STATES PATENT AND TRADEMARK OFFICE

CERTIFICATE OF CORRECTION

PATENT NO. : 7,174,819 B1
APPLICATION NO. : 09/622634
DATED : February 13, 2007
INVENTOR(S) : Gilles Petitjean It is certified that error appears in the above-identified patent and that said Letters Patent is hereby corrected as shown below:

In claim 1, column 10, line 20, delete the word "at".

Signed and Sealed this

Fourth Day of March, 2008

JON W. DUDAS
*Director of the United States Patent and Trademark Office*